US007315123B2

(12) United States Patent
Hur et al.

(10) Patent No.: US 7,315,123 B2
(45) Date of Patent: Jan. 1, 2008

(54) PLASMA DISPLAY PANEL (PDP)

(75) Inventors: Min Hur, Suwon-si (KR); Hoon-Young Choi, Suwon-si (KR); Young-Do Choi, Suwon-si (KR); Takahisa Mizuta, Suwon-si (KR); Yoon-Hyoung Cho, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/156,605

(22) Filed: Jun. 21, 2005

(65) Prior Publication Data

US 2006/0033448 A1 Feb. 16, 2006

(30) Foreign Application Priority Data

Jun. 30, 2004 (KR) ..... 10-2004-0050584
Jun. 30, 2004 (KR) ..... 10-2004-0050725
Jun. 30, 2004 (KR) ..... 10-2004-0050726
Jun. 30, 2004 (KR) ..... 10/2004-0050741
Jun. 30, 2004 (KR) ..... 10/2004-0050742
Jun. 30, 2004 (KR) ..... 10/2004-0050743

(51) Int. Cl.
*H01J 17/49* (2006.01)
*H01J 1/46* (2006.01)

(52) U.S. Cl. ..... 313/586; 313/610; 313/306

(58) Field of Classification Search ..... 315/167, 315/169.1, 169.4; 313/485, 496, 581–582, 313/584–586, 306, 307, 610, 609, 631
See application file for complete search history.

(56) References Cited

U.S. PATENT DOCUMENTS 5,541,618 A 7/1996 Shinoda ..... 345/60
5,661,500 A 8/1997 Shinoda et al. ..... 345/60
5,663,741 A 9/1997 Kanazawa ..... 345/66

(Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Thuy Vinh Tran
(74) *Attorney, Agent, or Firm*—Robert E. Bushnell, Esq.

(57) ABSTRACT

A Plasma Display Panel (PDP) includes: first and second substrates arranged opposite to each other; address electrodes arranged parallel to each other on the first substrate; barrier ribs arranged in a space between the first and second substrates to divide a plurality of discharge cells; phosphor layers respectively arranged within the discharge cells; first and second electrodes arranged on the second substrate corresponding to the respective discharge cells, the first and second electrodes extending in a direction crossing the address electrodes; and third and fourth electrodes, separated from the first and second electrodes, and projecting toward the first substrate in a direction away from the second substrate, the third and fourth electrodes facing each other with a space therebetween.

39 Claims, 20 Drawing Sheets

U.S. PATENT DOCUMENTS

| | | | | |
|---|---|---|---|---|
| 5,674,553 | A | 10/1997 | Sinoda et al. | 427/68 |
| 5,724,054 | A | 3/1998 | Shinoda | 345/60 |
| 5,786,794 | A | 7/1998 | Kishi et al. | 345/60 |
| 5,952,782 | A | 9/1999 | Nanto | 313/84 |
| RE37,444 | E | 11/2001 | Kanazawa | 345/67 |
| 6,630,916 | B1 | 10/2003 | Shinoda | 345/60 |
| 6,707,436 | B2 | 3/2004 | Setoguchi et al. | 345/60 |
| 6,960,882 | B2 * | 11/2005 | Kobayashi | 313/586 |
| 7,002,295 | B2 * | 2/2006 | Kojima et al. | 313/582 |
| 7,170,227 | B2 * | 1/2007 | Kim et al. | 313/582 |
| 2002/0003405 | A1 * | 1/2002 | Kang | 313/586 |
| 2002/0130619 | A1 | 9/2002 | Mori et al. | |
| 2004/0155583 | A1 * | 8/2004 | Kim et al. | 313/582 |
| 2004/0178730 | A1 * | 9/2004 | Shinoda et al. | 313/582 |
| 2005/0017637 | A1 * | 1/2005 | Kang et al. | 313/582 |

FOREIGN PATENT DOCUMENTS

| | | |
|---|---|---|
| JP | 2845183 | 10/1998 |
| JP | 2917279 | 4/1999 |
| JP | 2000-188063 | 7/2000 |
| JP | 2001-043804 | 2/2001 |
| JP | 2001-325888 | 11/2001 |
| JP | 2002-270100 | 9/2002 |
| JP | 2004-039578 | 2/2004 |
| KR | 10-2003-0083564 | 10/2003 |

* cited by examiner

PLASMA DISPLAY PANEL (PDP)

CLAIM OF PRIORITY

This application makes reference to, incorporates the same herein, and claims all benefits accruing under 35 U.S.C. § 119 from the six (6) applications all of which are entitled PLASMA DISPLAY PANEL, and are earlier filed in the Korean Intellectual Property Office on 30 Jun. 2004, and there duly assigned Ser. Nos. 10-2004-0050584, 10-2004-0050725, 10-2004-0050726, 10-2004-0050741, 10-2004-0050742 and 10-2004-0050743, respectively.

BACKGROUND OF THE INVENTION

1. Field of the Invention

The present invention relates to a Plasma Display Panel (PDP) and, more particularly, to a PDP having an electrode structure which is advantageous in realizing higher density and high luminance display.

2. Description of the Related Art

A Plasma Display Panel (PDP) is a display element which realizes an image using visible light generated by exciting phosphors with Vacuum UltraViolet (VUV) light radiated by a plasma obtained by the discharge of gas. Such a PDP can realize an extra-large screen of over 60 inches with a thickness of no more than 10 cm. Since the PDP is a self-emitting display device as is a Cathode Ray Tube (CRT), it has good color reproduction and does not have a distortion phenomenon depending upon the viewing angle. Furthermore, the PDP has good productivity and low-manufacturing cost since it has a simple manufacturing method compared to that of a Liquid Crystal Display (LCD), etc. Thus, the PDP has been spotlighted as a next-generation industrial flat panel display and a home TV display.

The structure of a PDP has been developed over a long period of time since the 1970's. The most common structure is a three-electrode coplanar discharge structure. The three-electrode coplanar discharge type structure includes one substrate having two electrodes disposed on the same plane, and the other substrate, which is separated from the one substrate by a predetermined gap therebetween, and has address electrodes extending in a perpendicular direction. In the three-electrode coplanar discharge structure, a discharge gas is sealed between the two substrates.

A PDP employs a glow discharge so as to produce visible light, which is visible with the naked eyes. A glow discharge occurs when an excited gas is generated due to the collision of electrons and gases. Ultraviolet light rays are generated by the excited gas. Ultraviolet light rays collide with phosphors within discharge cells to generate visible light. The generated visible light passes through a front transparent substrate and then reaches the naked eyes. A significant amount of input power is lost through these steps.

Glow discharge is usually obtained by supplying a voltage higher than a discharge firing voltage between two electrodes under a low atmospheric pressure (<1 atm). The discharge firing voltage is a function defined by the type of gas, the atmospheric pressure and the distance between electrodes. For an AC discharge, a discharge firing voltage is influenced by the capacitance (the dielectric constant, the electrode area and the thickness) of a dielectric material and a frequency of the supplied voltage as well as the above three factors.

In order for discharging to begin, a significant high voltage is needed. Once a discharge has been generated, however, distribution of a voltage between the cathode and the anode has a distorted shape due to a difference in spatial charges generated in the vicinity of the cathode and the anode. Most of a voltage is consumed in the vicinity of two electrodes, i.e., in regions called a cathode sheath and an anode sheath. The amount of voltage consumed in a positive column region is relatively insignificant. More particularly, in a glow discharge generated in a PDP, it is known that a voltage consumed in the cathode sheath is significantly higher than that consumed in the anode sheath.

Visible light is emitted by the collision of ultraviolet light rays and the phosphors. Ultraviolet light rays are generated when the energy level of Xenon (Xe) changes from an excited state to a ground state. Xenon (Xe) in the excited state is produced by the collision of Xenon (Xe) in the ground state and electrons. Accordingly, in order to increase the ratio of generated visible light with respect to the input power, i.e., the emission efficiency, it is necessary to increase the electron heating efficiency.

The electron heating efficiency in the positive column region is generally higher than the electron heating efficiency in the cathode sheath region. Thus, the emission efficiency of a PDP can be improved by increasing the positive column region. Since thicknesses of the sheath regions are almost the same under the same pressure, it is necessary to increase the length of the discharge in order to increase the emission efficiency.

In a PDP having a three-electrode structure, the discharge occurs in a region where the distance between two electrodes is the smallest (i.e., a central portion of a discharge cell). The discharge then moves to the edge regions of the electrodes. The reason why the discharge is generated at the central region is that a discharge firing voltage in that region is low. The discharge firing voltage is a function of a multiplication of the pressure and the distance between electrodes. A PDP operating region is located at the right side in which the Paschen curve has a minimum value. Once the discharge is begun, it is maintained by a voltage that is significantly lower than the discharge firing voltage due to the formation of spatial charges. A voltage supplied between two electrodes gradually lowers as time goes by. After the discharge has occurred, as ions and electrons are accumulated in the central region, the intensity of an electric field weakens and the discharge in this region disappears.

A cathode spot and an anode spot move to a region where surface charges do not exist as time goes by, i.e., in the vicinity of electrode edges. Since a voltage supplied between two electrodes decreases as time goes by, a strong discharge is generated at the central region (a structure having a low emission efficiency) of a discharge cell, and a weak discharge is generated in the vicinity of discharge cell edges (a structure having a high emission efficiency). Due to this, an existing three-electrode coplanar discharge structure is inevitably low in the ratio of generated heat electrons with respect to input power. This results in a low emission efficiency.

In order to solve the above-mentioned problems of the three-electrode structure, the distance between display electrodes must be increased to cause a discharge firing voltage to increase.

SUMMARY OF THE INVENTION

An object of the present invention is to provide a PDP which is capable of alleviating the problem of the intensity of a discharge being reduced in the vicinity of edges of discharge cells by forming a metal electrode close to a phosphor layer at the edges of the discharge cells.

Another object of the present invention is to provide a PDP having a discharge cell structure in which a sustain discharge generated between a pair of display electrodes can be induced through an opposite discharge in order to overcome disadvantages of a discharge, which are caused as the size of a discharge cell become small.

These and other objects of the present invention can be achieved by providing a Plasma Display Panel (PDP) comprising: first and second substrates arranged opposite to each other; address electrodes arranged parallel to each other on the first substrate; barrier ribs arranged in a space between the first and second substrates to divide a plurality of discharge cells; phosphor layers respectively arranged within the discharge cells; first and second electrodes arranged on the second substrate corresponding to the respective discharge cells, the first and second electrodes extending in a direction crossing the address electrodes; and third and fourth electrodes, separated from the first and second electrodes, and projecting toward the first substrate in a direction away from the second substrate, the third and fourth electrodes facing each other with a space therebetween.

The third and fourth electrodes are preferably arranged in layers different from layers in which the first and second electrodes are arranged.

The third and fourth electrodes are preferably separated from each other by the first and second electrodes and a dielectric layer therebetween.

The first and second electrodes are preferably covered with a dielectric layer, and ends of the third and fourth electrodes closer to the first substrate preferably project toward the first substrate more than toward the surface of the dielectric layer corresponding to the center of the discharge cell.

The third and fourth electrodes preferably have a thickness in a thickness direction of the panel greater than that of the first and second electrodes.

Cross-sections of the third and fourth electrodes, cut in a plane perpendicular to a length direction, are preferably longer in a direction perpendicular to the substrate than in a direction parallel to the substrate.

The third and fourth electrodes preferably comprise a metal.

The PDP preferably further comprises a first dielectric layer arranged to cover the first and second electrodes on the second substrate; the third and fourth electrodes are preferably arranged over the first dielectric layer; and a second dielectric layer is preferably arranged to surround the third and fourth electrodes.

A thickness of the second dielectric layer arranged on a surface in which the third and fourth electrodes face the first substrate is preferably greater than a thickness of the second dielectric layer arranged on a surface in which the third and fourth electrodes are opposite to each other.

The second dielectric layer preferably comprises an opaque dielectric material.

The first and second electrodes are preferably respectively arranged over the discharge cells adjacent to the edges of the discharge cells.

The third and fourth electrodes are preferably respectively arranged over the discharge cells adjacent to the edges of the discharge cells.

Each of the first and second electrodes preferably includes bus electrodes respectively corresponding to the discharge cells and extending along a direction intersecting the address electrodes, and expansion electrodes extending from the bus electrodes toward the center of each of the discharge cells.

The third and fourth electrodes are preferably arranged at locations where the third and fourth electrodes overlap the bus electrodes of the first and second electrodes, when seen from the front of the panel.

The width of the bus electrodes of the first and second electrodes is preferably greater than that of the third and fourth electrodes, in a direction parallel to the address electrodes.

The third and fourth electrodes preferably extend in a direction intersecting the address electrodes.

Each of the third and fourth electrodes preferably includes a plurality of unit electrodes, the plurality of unit electrodes being separated from each other and preferably arranged parallel to each other in a direction intersecting the address electrodes.

The third electrodes are preferably adapted to receive a voltage higher than that of the first electrodes, and the fourth electrodes are preferably adapted to receive a voltage higher than that of the second electrodes.

The first and third electrodes are preferably respectively connected to different signal voltage generators and are adapted to receive respective signal voltages and a voltage supplied to the first electrodes is preferably lower than a voltage supplied to the third electrodes.

The second and fourth electrodes are preferably respectively connected to different signal voltage generators and are adapted to receive respective signal voltages and a voltage supplied to the second electrodes is preferably lower than a voltage supplied to the fourth electrodes.

Terminals of the first and third electrodes are preferably connected to the same signal voltage generator and a resistor is preferably arranged between the first electrode and the signal voltage generator.

Terminals of the second and fourth electrodes are preferably connected to the same signal voltage generator and a resistor is preferably arranged between the second electrode and the signal voltage generator.

The third electrodes are preferably adapted to receive the same voltage as that of the first electrodes and the fourth electrodes are preferably adapted to receive the same voltage as that of the second electrodes.

The terminals of the first and third electrodes are preferably adapted to be electrically connected together.

The terminals of the second and fourth electrodes are preferably adapted to be electrically connected together.

Each of the first and second electrodes preferably includes bus electrodes that respectively correspond to the discharge cells and extend in a direction intersecting the address electrodes and projection electrodes that project from the bus electrodes toward the center of each of the discharge cells; the projection electrodes preferably include large-width parts arranged at the centers of the discharge cells, small-width parts adapted to be connected to the bus electrodes and having a width smaller than that of the large-width parts, and connection parts adapted to connect the large-width parts and the small-width parts.

The large-width parts preferably have a width greater than that of the small-width parts, and the small-width parts have a width greater than that of the connection parts.

The large-width parts preferably have an area greater than that of the small-width parts and the connection parts.

The large-width parts are preferably arranged in a straight line along a direction in which the large-width parts cross the address electrodes.

The large-width parts preferably extend in the same direction as that of the address electrodes.

The small-width parts of the projection electrodes preferably have a width greater than that of the bus electrodes.

The small-width parts of the projection electrodes preferably have a width greater than that of the third and fourth electrodes.

The PDP preferably further comprises a dielectric layer adapted to cover the first and second electrodes, the dielectric layer including a groove corresponding to the central portion of the discharge cell.

A width of the groove in the dielectric layer, measured in a direction parallel to the address electrodes, is preferably greater than a discharge gap between the first and second electrodes.

The groove in the dielectric layer preferably has a depth adapted to expose the surface of the second substrate.

The dielectric layer preferably includes a first plane arranged adjacent to the groove along the groove, and a second plane arranged adjacent to the first plane and projecting toward the first substrate more than towards the first plane.

The first and second electrodes are preferably alternately arranged in discharge cells and are adjacent to each other in a direction parallel to the address electrodes, and, in each of the third and fourth electrodes, one electrode is preferably shared by a pair of discharge cells, the third and fourth electrodes being adjacent to each other in a direction parallel to the address electrodes.

The barrier ribs preferably include first barrier rib members extending in a direction parallel to the address electrodes, and second barrier rib members crossing the first barrier rib members and respectively dividing the discharge cells into independent spaces; the third and fourth electrodes are preferably arranged over the second barrier rib members, and a pair of discharge cells, adjacent in a length direction of the address electrodes, preferably share at least one electrode.

The third and fourth electrodes preferably have a plurality of unit electrodes separated from each other and arranged parallel to each other along a direction intersecting the address electrodes.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
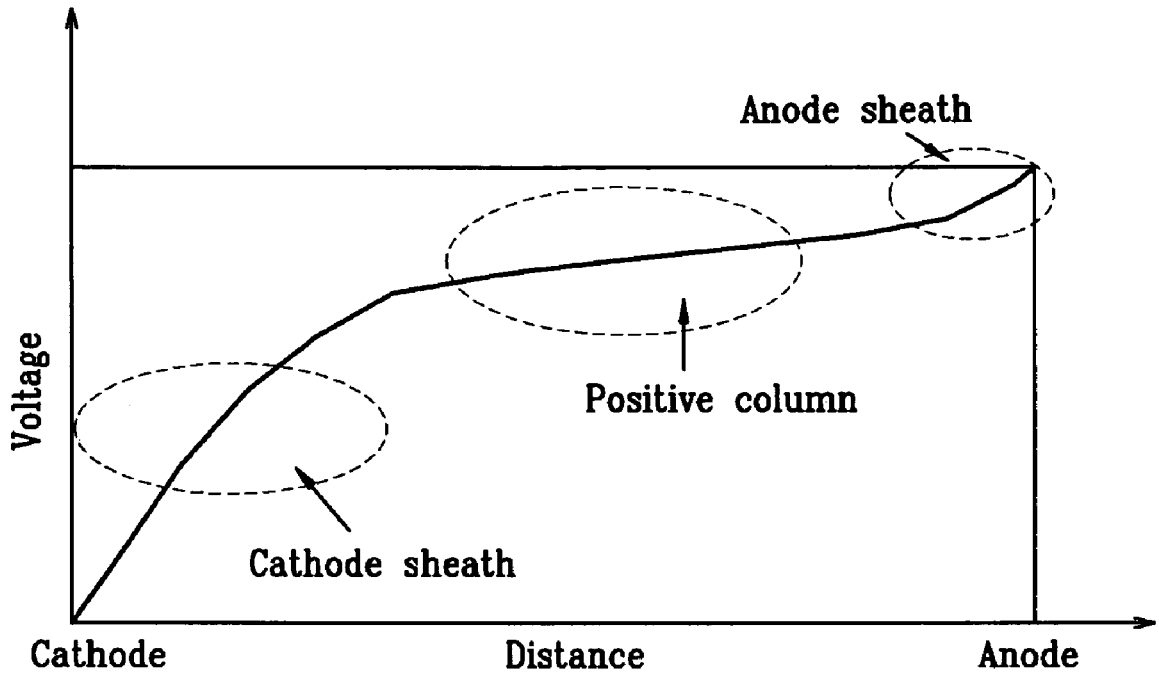
FIG. 1 is a graph of the distribution of a voltage supplied between a cathode and an anode in a glow discharge.

FIG. 1 is a graph of the distribution of a voltage supplied between a cathode and an anode in a glow discharge In order for discharging to begin, a significant high voltage is needed. Once a discharge has been generated, however, distribution of a voltage between the cathode and the anode has a distorted shape, as shown in FIG. 1, due to a difference in spatial charges generated in the vicinity of the cathode and the anode. Most of a voltage is consumed in the vicinity of two electrodes, i.e., in regions called a cathode sheath and an anode sheath. The amount of voltage consumed in a positive column region is relatively insignificant. More particularly, in a glow discharge generated in a PDP, it is known that a voltage consumed in the cathode sheath is significantly higher than that consumed in the anode sheath.

Exemplary embodiments of the present invention are described below in more detail with reference to the accompanying drawings so that those having ordinary skill in the art can readily practice the present invention. However, the present invention can be implemented in a variety of different ways and the scope of the present invention is not limited to these exemplary embodiments. In the drawings, in order to clearly describe the present invention, parts having no connection with the description have been omitted. Like reference numerals are used to identify the same or similar parts.

Figure 2:
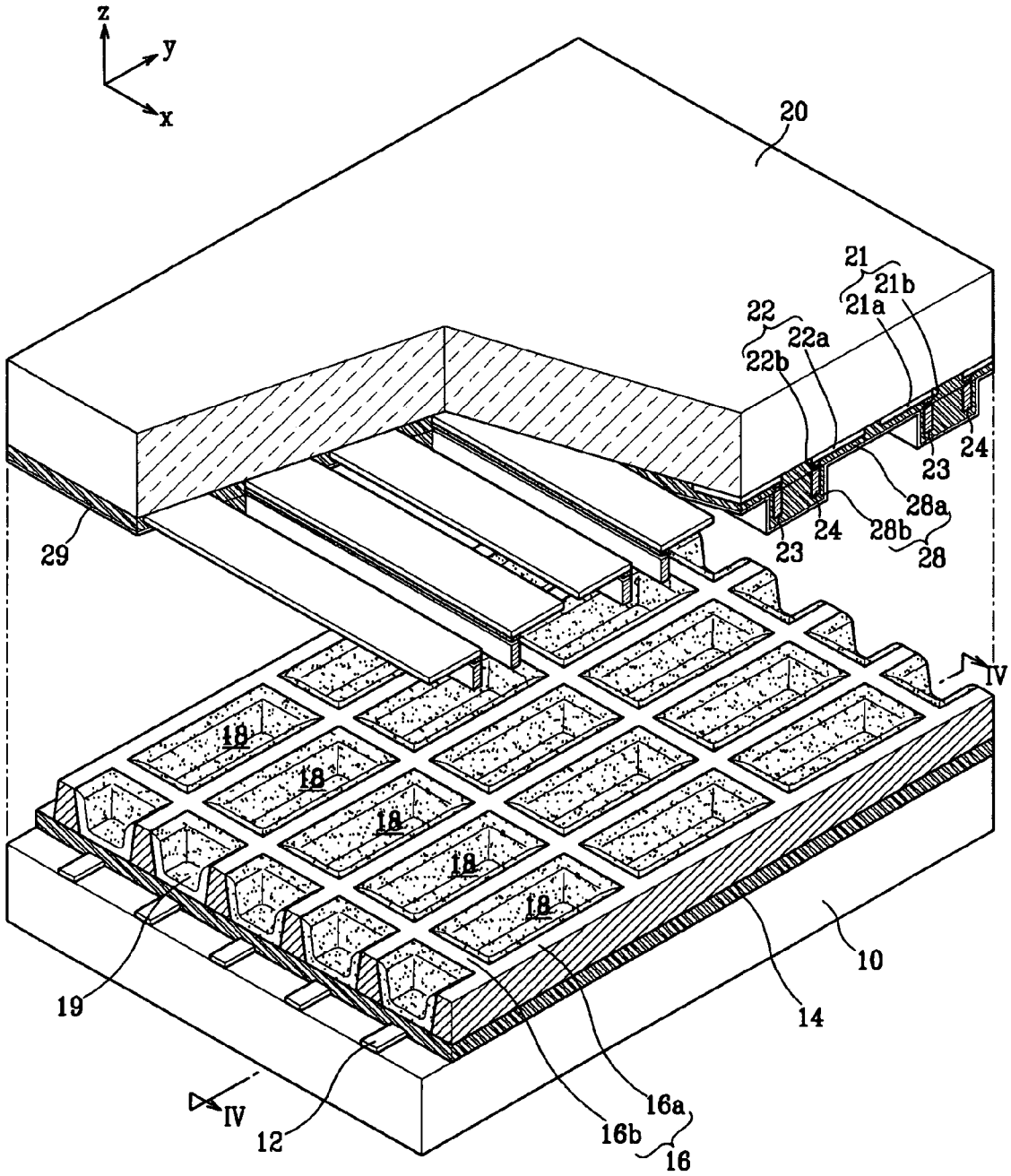
FIG. 2 is an exploded perspective view of a PDP according to a first embodiment of the present invention.
Figure 3:
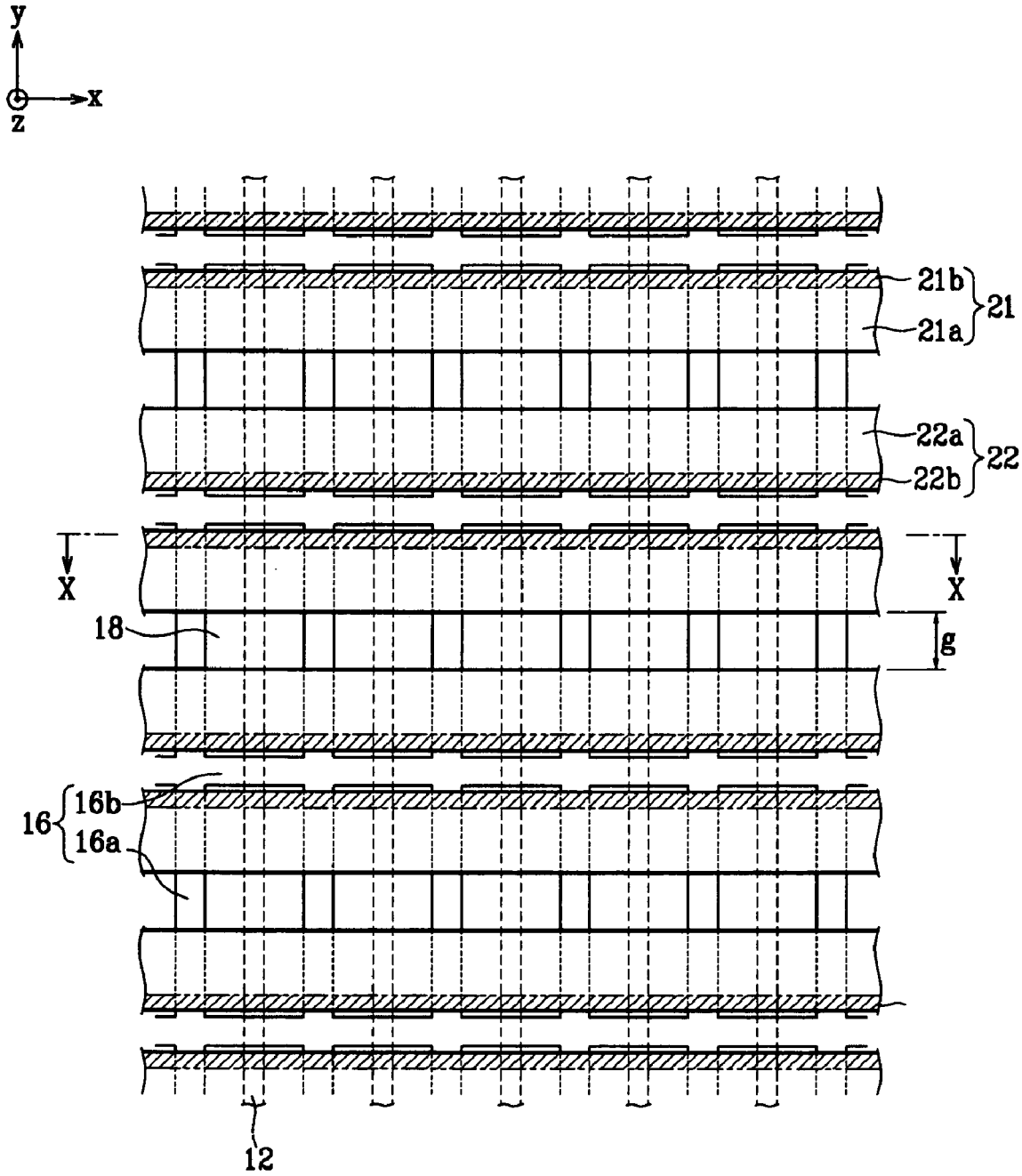
FIG. 3 is a plan view of the structure of electrodes and discharge cells in the PDP according to the first embodiment of the present invention.
Figure 4:
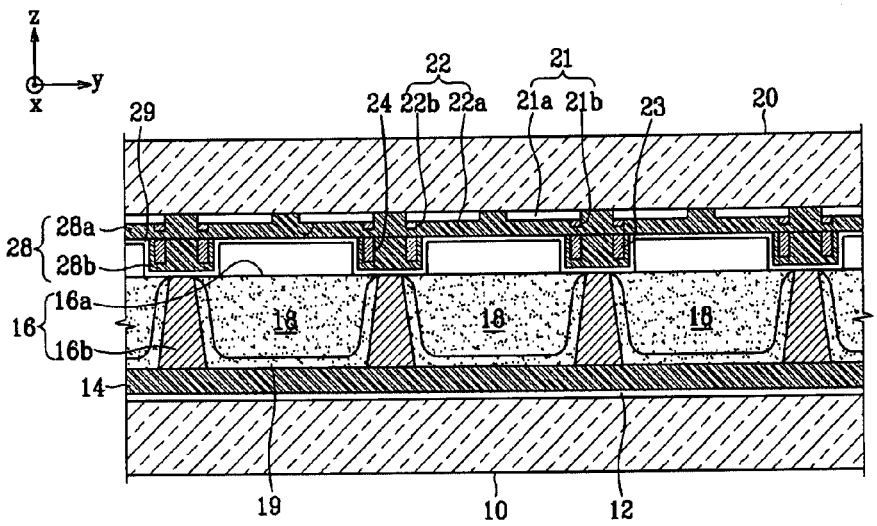
FIG. 4 is a cross-sectional view of the PDP taken along the line IV-IV in FIG. 2.

FIG. 2 is an exploded perspective view of the PDP according to a first embodiment of the present invention. FIG. 3 is a plan view of the structure of electrodes and discharge cells in the PDP. FIG. 4 is a cross-sectional view of the PDP taken along the line IV-IV in FIG. 2.

Referring to FIGS. 2 to 4, the PDP according to the present embodiment includes a first substrate 10 (hereinafter, referred to as a "rear substrate") and a second substrate 20 (hereinafter, referred to as a "front substrate"), which are disposed opposite to each other with a predetermined distance therebetween, and a plurality of discharge cells 18, which are defined by barrier ribs 16, in a space between the two substrates 10 and 20. Phosphor layers 19, which absorb ultraviolet light rays and emit a visible light, are formed within the discharge cells 18 along the barrier ribs and the bottom surface. The phosphor layers 19 are filled with a discharge gas (e.g., a mixed gas including Xenon (Xe), Neon (Ne) and the like) so that they can generate a plasma discharge.

Address electrodes 12 are formed along one direction (the y-axis direction in the drawings) on a surface of the rear substrate 10, which faces the front substrate 20. A dielectric layer 14 is formed on the entire inner surface of the rear substrate 10 to cover the address electrodes 12. The address electrodes 12 are formed parallel to each other, while keeping a predetermined distance apart from adjacent address electrodes 12.

The barrier ribs 16 are formed on the dielectric layer 14 formed on the rear substrate 10. In the present embodiment, the barrier ribs 16 include first barrier rib members 16*a* that extend parallel to the address electrodes 12, and second barrier rib members 16*b*, which are formed to intersect the first barrier rib members 16*a* and divide the discharge cells 18 into independent discharge spaces, respectively. This barrier rib structure is not limited to the aforementioned structure. A stripe type barrier rib structure consisting of only the barrier rib members parallel to the address electrodes can also be applied to the present invention. Furthermore, barrier rib structures of various shapes, which divide discharge cells, are also possible, which also fall within the scope of the present invention.

Referring to FIG. 3, first electrodes 21 and second electrodes 22 are formed on the inner surface of the front substrate 20 opposite to the rear substrate 10 and extend in a direction intersecting the address electrodes 12 (the x-axis direction in the drawing). In the present embodiment, the first electrodes 21 include bus electrodes 21*b* respectively corresponding to the discharge cells 18, which extend in a direction in which the bus electrodes 21*b* intersect the address electrodes 12, and expansion electrodes 21*a*, which extend from the bus electrodes 21*b* toward the center of the discharge cells 18 to form a predetermined discharge gap g. The second electrodes 22 include bus electrodes 22*b* respectively corresponding to the discharge cells 18, which extend in a direction intersecting the address electrodes 12, and expansion electrodes 22*a*, which extend from the bus electrodes 22*b* toward the center of the discharge cells 18 and then form a predetermined discharge gap g. The bus electrodes 21*b* and 22*b* can be made of a metal. The expansion electrodes 21*a* and 22*a* are preferably formed of a transparent electrode, such as an Indium Tin Oxide (ITO) electrode, in order to secure the aspect ratio.

The first and second electrodes 21 and 22 correspond to the discharge cells 18 to be involved in a discharge of a sustain period. One of the first and second electrodes 21 and 22 is involved in a discharge of an address period together with the address electrodes 12. However, the respective electrodes can play different roles depending upon the signal voltages supplied. The present invention is not limited thereto.

Referring to FIG. 4, in the present embodiment, third and fourth electrodes 23 and 24 are formed on the front substrate 20 so as to be separated from the first and second electrodes 21 and 22, respectively. The third and fourth electrodes 23 and 24 are disposed at locations where they approximately overlap the bus electrodes 21*b* and 22*b* of the first and second electrodes 21 and 22, respectively, when seen from the front of the panel. The third and fourth electrodes 23 and 24 are separated from the first and second electrodes 21 and 22, respectively, and are projected toward the rear substrate 10 in a direction in away from the front substrate 20 (the minus z-axis direction in the drawing). The projected third and fourth electrodes 23 and 24 are formed to face each other with a space therebetween. This space can induce an opposite discharge between the third and fourth electrodes 23 and 24, which are opposite to each other. These third and fourth electrodes 23 and 24 are preferably made of a metal.

In the present embodiment, the third and fourth electrodes 23 and 24 are formed in layers different from layers in which the first and second electrodes 21 and 22 are formed. That is, in the front substrate 20, a first dielectric layer 28*a* is formed to cover the first and second electrodes 21 and 22. The third and fourth electrodes 23 and 24 are formed on the first dielectric layer 28*a*. A second dielectric layer 28*b* is formed to surround the third and fourth electrodes 23 and 24. The first dielectric layer 28*a* is preferably formed of a transparent dielectric material so that it can emit visible light generated within the discharge cells 18. The second dielectric layers 28*b* can be formed of the same material as that of the first dielectric layer 28*a*, but they can be formed of an opaque dielectric material in order to improve the bright and dark contrast of a PDP.

As the third and fourth electrodes 23 and 24 are projected and the second dielectric layers 28*b* are formed to surround the third and fourth electrodes 23 and 24, dielectric material blocks are formed among adjacent discharge cells 18. The dielectric material blocks can prevent ion and electrons from moving among adjacent discharge cells 18, thereby significantly reducing the generation of crosstalk. Therefore, it can reduce an erroneous discharge among on-off cells.

The bus electrodes 21*b* and 22*b* of the first and second electrodes 21 and 22 are formed adjacent to the edges of each of the discharge cells 18 so that they are located over the discharge cells 18. The third and fourth electrodes 23 and 24 extend along a direction intersecting the address electrodes 12 at locations corresponding to the bus electrodes 21*b* and 22*b*. That is, the third and fourth electrodes 23 and 24 are also formed adjacent to the edges of each of the discharge cells 18 and are located over the discharge cells 18. However, the third and fourth electrodes 23 and 24 are separated from the first and second electrodes 21 and 22 with a dielectric layer therebetween.

An MgO protection film 29 is formed on the first dielectric layer 28*a* and the second dielectric layers 28*b* to protect the dielectric layer from collision by ions of atoms, which are ionized upon a plasma discharge. This MgO protection film 29 has an advantage in that it can increase the discharge efficiency since the emission coefficient of secondary electrons when ions collide against each other is high.

In order to drive the PDP constructed above, an external voltage is selectively supplied to one of the third and fourth electrodes 23 and 24 or one of the bus electrodes 21*b* and 22*b* of the first and second electrodes 21 and 22. Specifically, any one of the groups of the third and fourth electrodes 23 and 24 and the bus electrodes 21*b* and 22*b* of the first and second electrodes 21 and 22 becomes a floating electrode. A potential difference is generated between the third and fourth electrodes 23 and 24 and the bus electrodes 21*b* and 22*b* of the first and second electrodes 21 and 22 due to the capacitive coupling.

Figure 5:
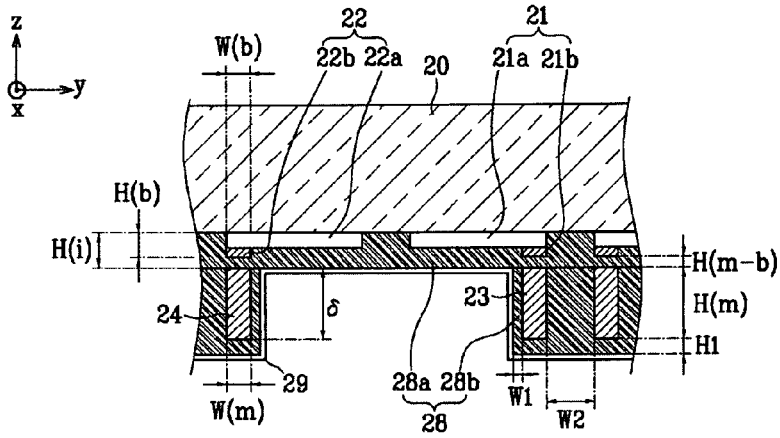
FIG. 5 is a detailed cross-sectional view of the structure of a front plate of the PDP according to the first embodiment of the present invention.
Figure 6A:
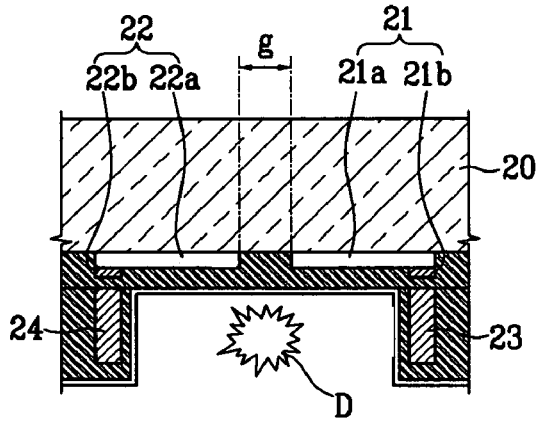
FIGS. 6A to 6D are cross-sectional views of the size and location of a cathode spot and an anode spot depending upon the time after a discharge has occurred in the PDP according to the first embodiment of the present invention.
Figure 6B:
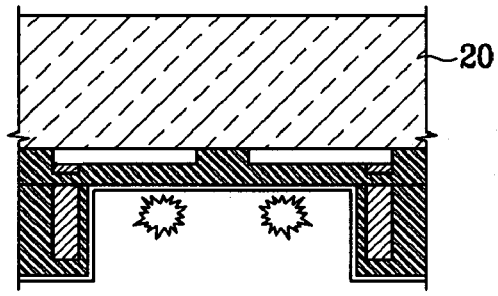
Figure 6C:
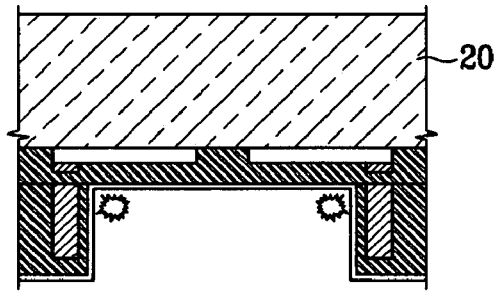
Figure 6D:
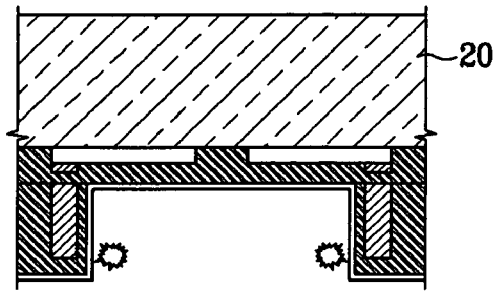

FIG. 5 is a detailed cross-sectional view of the structure of the front plate of the PDP according to a first embodiment of the present invention.

In the present embodiment, in order to generate an opposite discharge between the third and fourth electrodes 23 and 24, it is preferable for the end of the third electrodes 23 (or the fourth electrodes 24) closer to the rear substrate 10 to project more toward the rear substrate 10 than toward the surface of the first dielectric layer 28*a* corresponding to the central portion of the discharge cell 18. It is also preferable for the thickness of the panel, which is measured in a thickness direction (the z-axis direction in the drawing), to be greater than that of the bus electrodes 21*b* and 22*b* of the first and second electrodes 21 and 22. That is, referring to FIG. 5, the condition of d>0, H(b)<H(m) is satisfied, where d indicates the length of the third electrodes 23 (or the fourth electrodes 24), which projects from the surface of the first dielectric layer 28*a*, H(b) indicates the thickness of the bus electrodes 21*b* and 22*b*, which is measured from the surface of the front substrate 20, and H(m) indicates the thickness of the third electrodes 23 (or the fourth electrodes 24), which is measured in a thickness direction of the panel.

In order to fabricate this front plate structure, the dielectric layer that surrounds the electrodes formed on the front substrate 20 can be removed out by a sandblasting method, or some of the dielectric layer can be cut away using a photosensitive dielectric material or a green sheet. Furthermore, after an electrode unit including the third and fourth electrodes 23 and 24 is separately fabricated by means of a Thick Film Ceramic Sheet (TFCS) method, it can be coupled to the front substrate 20 in which the first and second electrodes 21 and 22 are formed.

When a width W(b) of the bus electrodes 21*b* and 22*b* and a width W(m) of the third electrodes 23 (or the fourth electrodes 24) are large or when a distance H(m-b) between the bus electrodes 21*b* and 22*b* and the third electrodes 23 (or the fourth electrodes 24) is small, the capacitance between two electrodes is increased. A discharge can be thus easily transferred from the first and second electrodes 21 and 22 on the front substrate 20 to the third and fourth electrodes 23 and 24.

The cross-sections of the third and fourth electrodes 23 and 24, which are cut in a plane perpendicular to a length direction thereof, can be longer in a length H(m) of a direction (the z-axis direction in the drawing), which is perpendicular to the surface of the substrate, than in a length W(m) of a direction (the y-axis direction in the drawing), which is parallel to the surface of the substrate. Specifically, the height from the surface of the front substrate 20 of the third and fourth electrodes 23 and 24 can be made larger. By doing so, if the size in a plane direction of a discharge cell has to be reduced so as to implement a higher density display, the reduced size can be compensated for by increasing the height of the third and fourth electrodes 23 and 24.

When the second dielectric layers 28*b* are formed to surround the third and fourth electrodes 23 and 24, the thickness (H1) of the second dielectric layers 28*b* formed on the surfaces of the third and fourth electrodes 23 and 24 which face the rear substrate 10 can be greater than the thickness (W1) of the second dielectric layers 28*b* formed on the surface in which the third and fourth electrodes 23 and 24 oppose each other, as shown in FIG. 5. Furthermore, the thickness (W2) of the second dielectric layers 28*b* formed between different electrodes between adjacent discharge cells 18 can be greater than the thickness (W1) of the second dielectric layers 28*b* formed on the surface in which the third and fourth electrodes 23 and 24 oppose each other. This structure can prevent an erroneous discharge from occurring between electrodes located in adjacent discharge cells at the time of a sustain discharge.

FIGS. 6A to 6D are cross-sectional views of the size and location of a cathode spot and an anode spot depending upon a time after a discharge occurs in the PDP according to the first embodiment of the present invention.

After a discharge D occurs in a region where the distance between the first and second electrodes 21 and 22 formed on the front substrate 20 is the closest (i.e., the center of the discharge cell 18), a voltage supplied to a discharge gap g decreases as ions and electrons are accumulated. Accordingly, the cathode spot and the anode spot move to a region where surface charges do not exist, i.e., an edge region of the discharge cell 18. Since the voltage supplied to the discharge gap g decreases as time goes by, the intensity of the discharge lowers (see FIGS. 6A and 6B)

In the structure according to the present embodiment, a discharge moves to the third and fourth electrodes 23 and 24 disposed at the edges of the discharge cell 18 unlike the existing three-electrode structure in which a discharge goes out in the edge region of the discharge cell 18. Since a discharge is more easily generated between the third and fourth electrodes 23 and 24 that utilize an opposite discharge than between the bus electrodes 21*b* and 22*b*, the intensity of the discharge on the surface of the third and fourth electrodes 23 and 24*a* does not lower much compared to that on the surface of the bus electrodes 21*b* and 22*b*. The discharge continues for a long time while the cathode spot and the anode spot move from an upper portion of the third and fourth electrodes 23 and 24 to a lower side thereof. The discharge disappears after surface charges are sufficiently accumulated on the dielectric layer that covers the third and fourth electrodes 23 and 24 (see FIGS. 6C and 6D).

If distances between two electrodes are the same, a discharge is likely to occur because a discharge firing voltage is much lower in the opposite discharge electrode structure than in the coplanar discharge electrode structure. The electrode structure of the PDP according to the present embodiment has an advantage in that the transfer of a discharge from the first and second electrodes 21 and 22 disposed in the front substrate 20 to the third and fourth electrodes 23 and 24 is easy. Accordingly, this structure is advantageous in that a discharge is maintained for a long time in a region having a long discharge path in which the emission efficiency is good (i.e., around the edge of the discharge cell).

Figure 7:
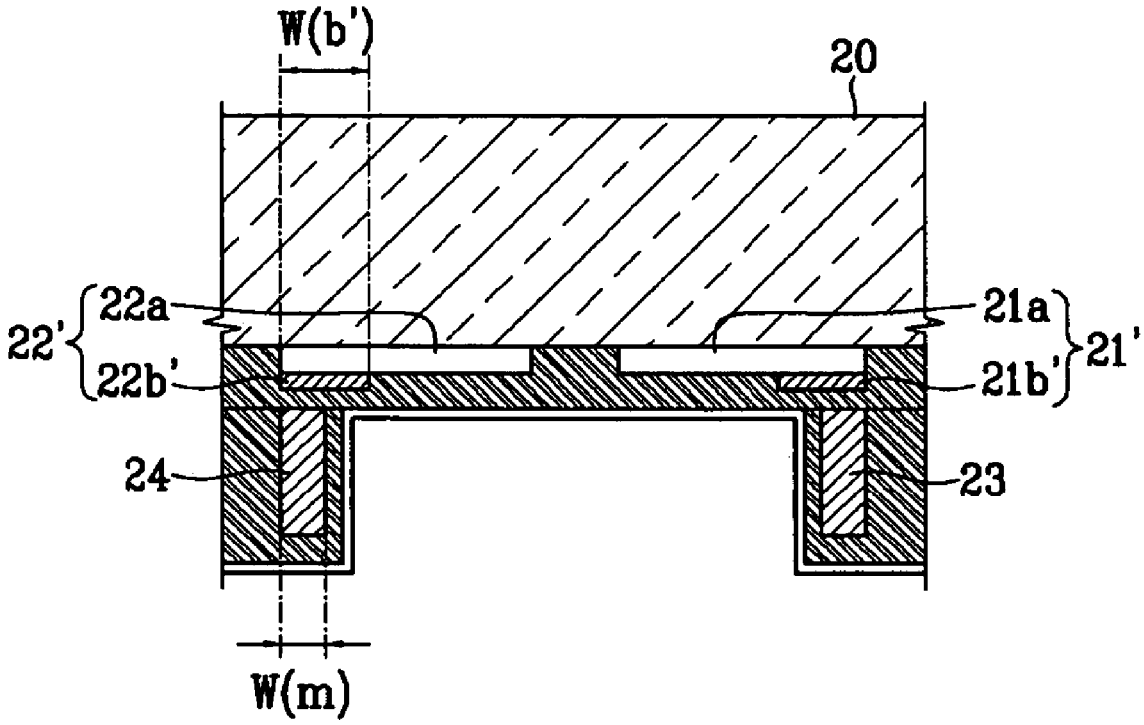
FIG. 7 is a cross-sectional view of a modification of the PDP according to the first embodiment of the present invention.

FIG. 7 is a cross-sectional view of a modification of the PDP according to the first embodiment of the present invention.

In accordance with this modification, the width W(b') of bus electrodes 21*b*' and 22*b*' of the first and second electrodes 21 and 22 is greater than the width W(m) of the third electrode 23 or the fourth electrode 24. The bus electrodes 21*b*' and 22*b*' are generally formed of an opaque metal electrode. Thus, if the widths are increased, the bright and dark contrast of a PDP can be improved.

Figure 8:
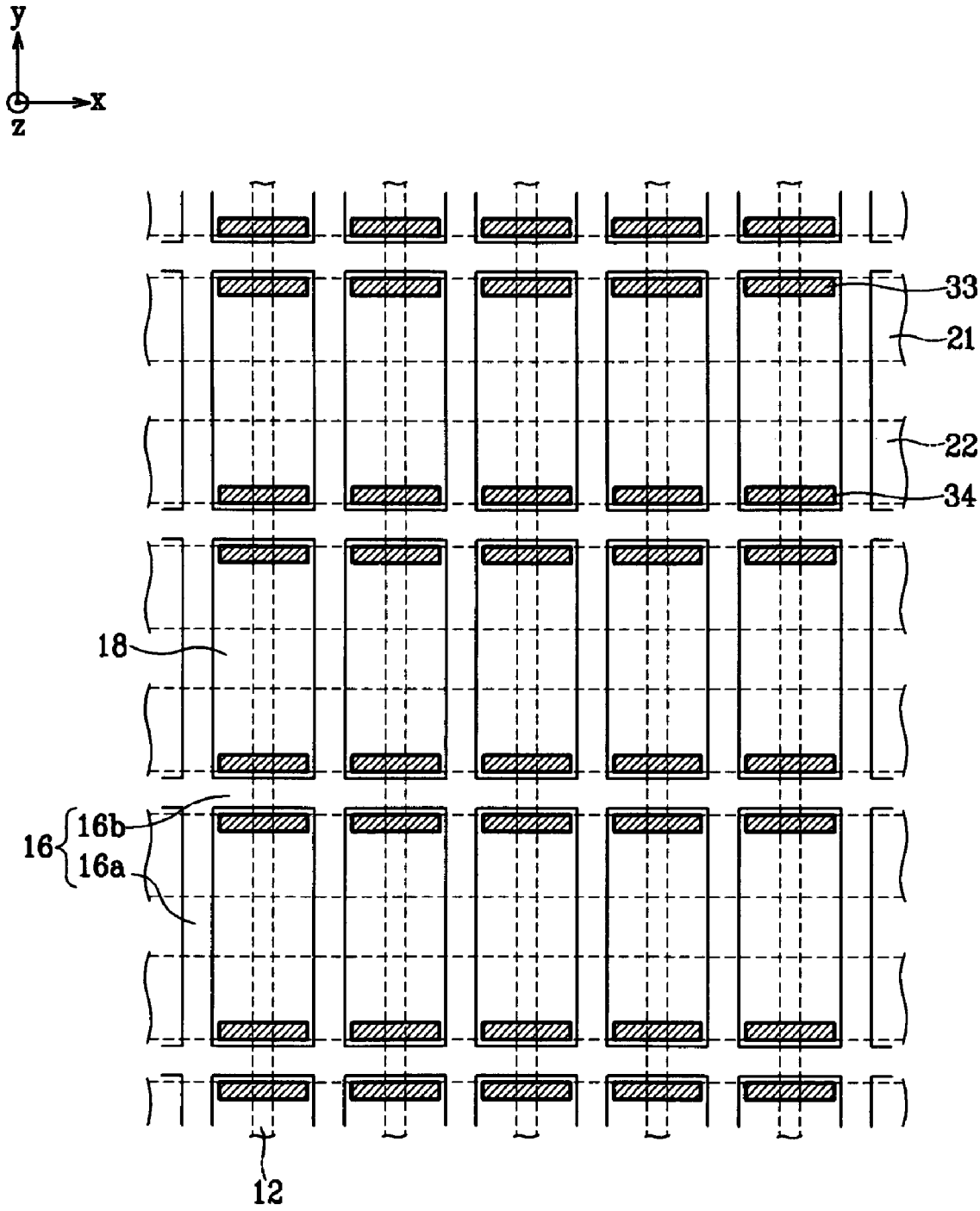
FIG. 8 is a plan view of the structure of electrodes and discharge cells in a PDP according to a second embodiment of the present invention.
Figure 9A:
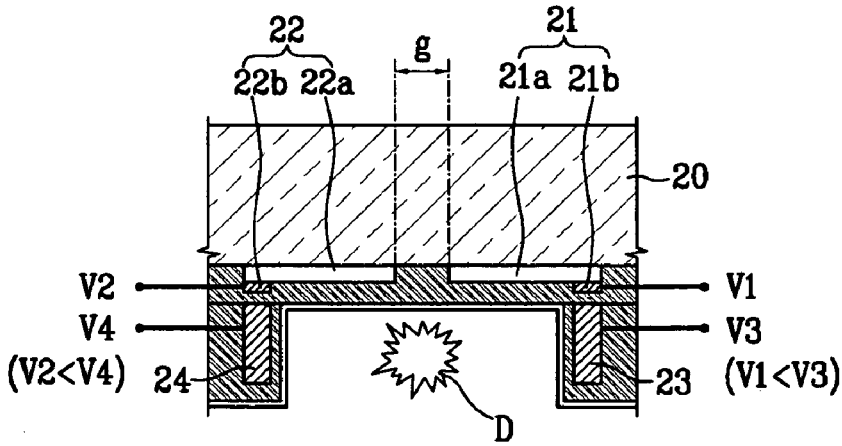
FIGS. 9A to 9D are cross-sectional views of the size and location of a cathode spot and an anode spot depending upon the time after a discharge has occurred in a PDP according to a third embodiment of the present invention.
Figure 9B:
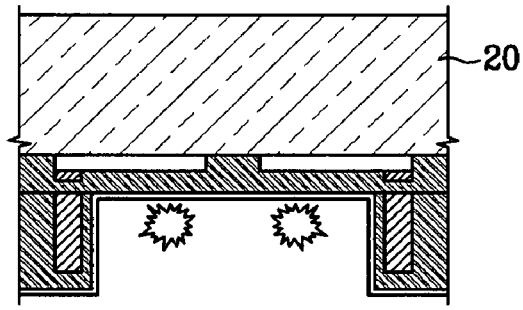
Figure 9C:
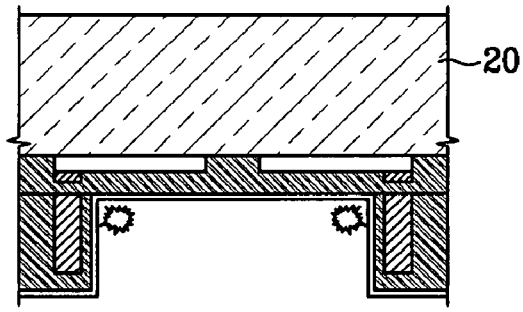
Figure 9D:
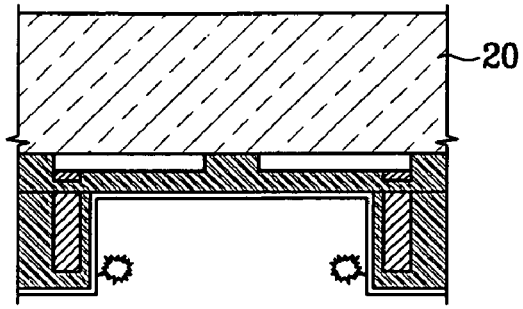

FIG. 8 is a plan view of the structure of electrodes and discharge cells in a PDP according to a second embodiment of the present invention.

In the PDP according to the present embodiment, in the same manner as the first embodiment, third and third electrodes 33 and 34 are formed in the front substrate so as to be separated from the first and second electrodes 21 and 22. The third and fourth electrodes 33 and 34 are projected toward the rear substrate in a direction away from the front substrate. The third and fourth electrodes 33 and 34 are formed to face each other with a space therebetween. The space can induce an opposite discharge between the third and fourth electrodes 33 and 34 opposing each other. These third and fourth electrodes 33 and 34 are preferably made of a metal.

Referring to FIG. 8, in the PDP according to the present embodiment, each of the third and fourth electrodes 33 and 34 includes a plurality of unit electrodes, which are separated from each other and arranged parallel to each other along a direction intersecting the address electrodes 12. A signal voltage driving the PDP is supplied from the first and second electrodes 21 and 22, and the third and fourth electrodes 33 and 34 become floating electrodes. In the same manner as the first embodiment, a potential difference is generated between the third and fourth electrodes 33 and 34 and the first and second electrodes 21 and 22 due to the capacitive coupling. The first and second electrodes 21 and 22 of the present embodiment can also include bus electrodes and expansion electrodes. However, detailed drawings of the bus electrodes and the expansion electrodes have been omitted for simplicity.

FIGS. 9A to 9D are cross-sectional views of a PDP according to a third embodiment of the present invention, and show the size and location of a cathode spot and an anode spot depending upon a time after a discharge has occurred. Different signal voltage generators supply different voltages V1 to V4 to respective electrodes.

In the present embodiment, a third electrode 23 has a voltage higher than that of a first electrode 21, and a fourth electrode 24 has a voltage higher than that of a second electrode 22.

The first and third electrodes 21 and 23 are connected to different signal voltage generators (not shown), respectively, and can receive the signal voltages V1 and V3, respectively. The voltage V3 supplied to the third electrode 23 is higher than the voltage V1 supplied to the first electrode 21.

Furthermore, the second and fourth electrodes 22 and 24 are respectively connected to different signal voltage generators (not shown), and can receive the signal voltages V2 and V4. The voltage V2 supplied to the second electrode 22 is higher than the voltage V4 supplied to the fourth electrode 24.

Figure 10:
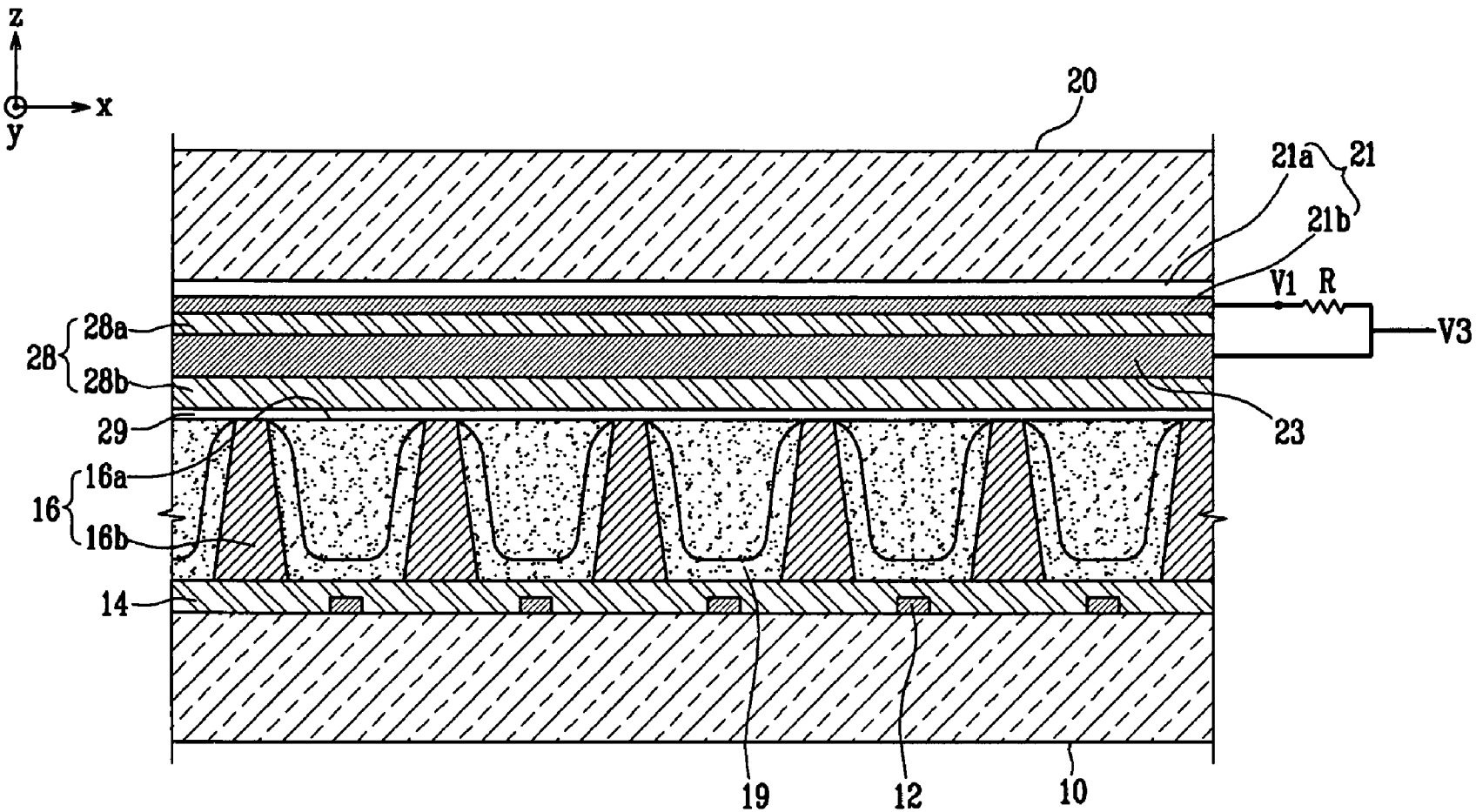
FIG. 10 is a cross-sectional view of the PDP according to the third embodiment of the present invention.

FIG. 10 is a cross-sectional view of the PDP according to a third embodiment of the present invention, and shows the relationship in which terminals are connected to electrodes in the cross-sectional view of the PDP taken along the line X-X in FIG. 3.

As shown in FIG. 10, the terminals of the first and third electrodes 21 and 23 are connected to the same signal voltage generator (not shown). Different voltages V1 and V3 can be supplied to the electrodes 21 and 23, respectively, by interposing a resistor R between the first electrode 21 and the signal voltage generator. The voltage V3 supplied to the third electrode 23 is higher than the voltage V1 supplied to the first electrode 21.

In a similar manner, the terminals of the second and fourth electrodes 22 and 24 are connected to the same signal voltage generator (not shown). Different voltages V2 and V4 can be supplied to the electrodes 22 and 24 by interposing a resistor R between the second electrode 22 and the signal voltage generator. The voltage V4 supplied to the fourth electrode 24 is higher than the voltage V2 supplied to the second electrode 22.

Figure 11:
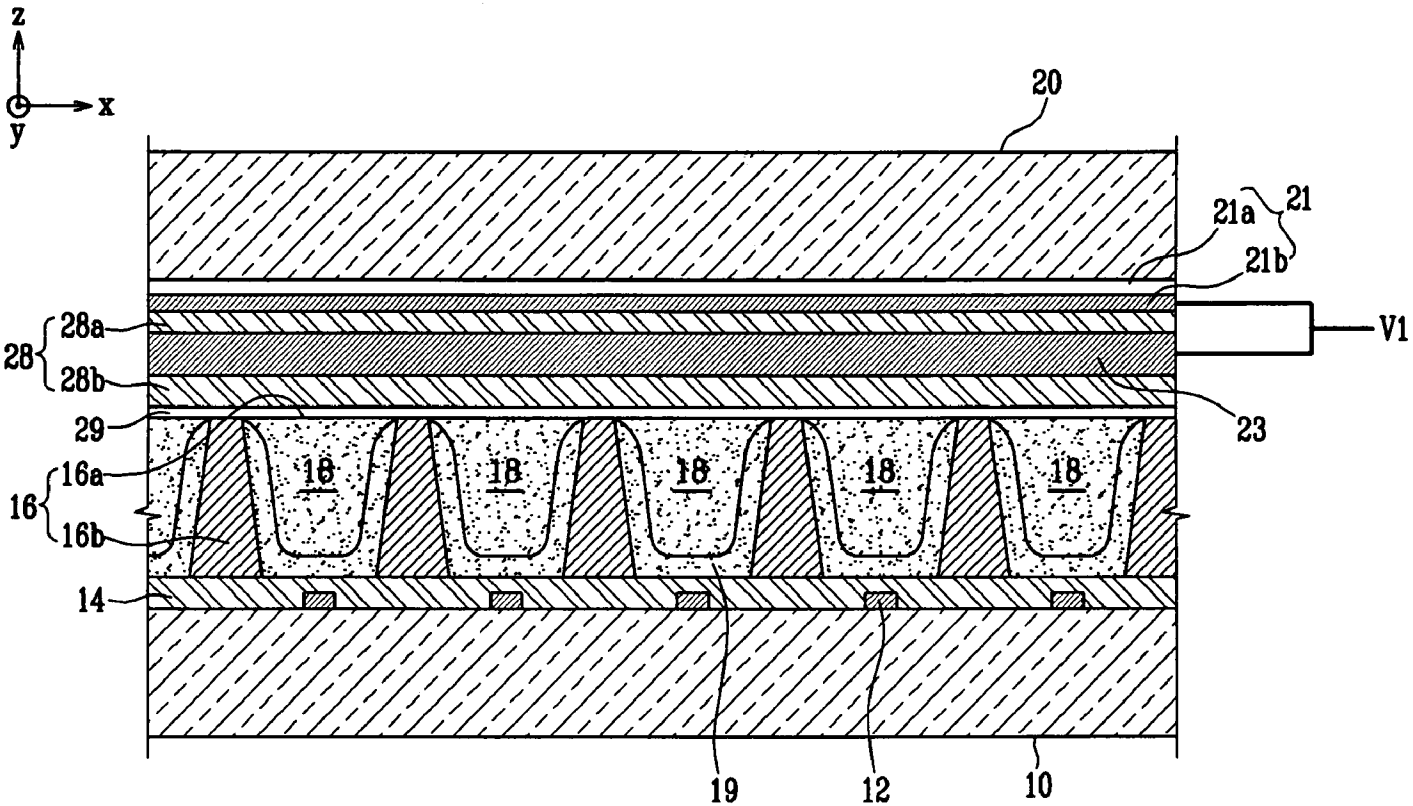
FIG. 11 is a cross-sectional view of a PDP according to a fourth embodiment of the present invention.
Figure 12A:
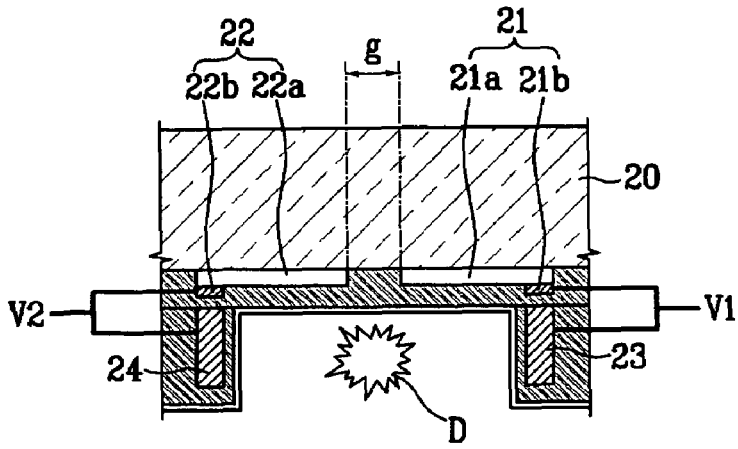
FIGS. 12A to 12D are cross-sectional views of the size and location of a cathode spot and an anode spot depending upon the time after a discharge has occurred in the PDP according to the fourth embodiment of the present invention.
Figure 12B:
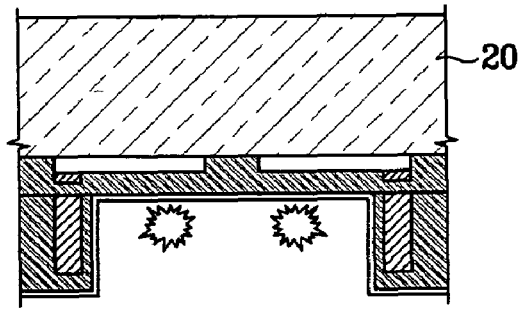
Figure 12C:
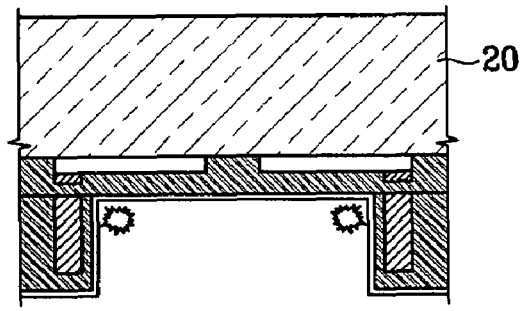
Figure 12D:
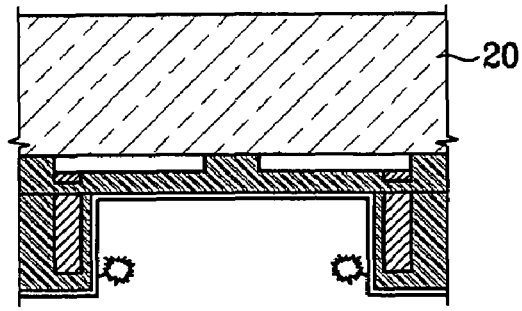

FIG. 11 is a cross-sectional view of a PDP according to a fourth embodiment of the present invention, and it shows the cross-sectional view of the PDP taken along the line X-X in FIG. 3 as a basis.

In the present embodiment, a third electrode 23 has substantially the same voltage as that of a first electrode 21, and a fourth electrode 24 has substantially the same voltage as that of a second electrode 22.

In the third and first electrodes 23 and 21, the terminals of the electrodes located at the edge of the panel are electrically connected. The same voltage V1 can be supplied through a common terminal unit. Alternatively, a driving circuit (not shown) can supply the same voltage V1 to the respective electrodes without a common terminal unit.

In the same manner, in the fourth and second electrodes 24 and 22, the terminals of the electrodes located at the edge of the panel are electrically connected. The same voltage V2 can be supplied through a common terminal unit. Alternatively, a driving circuit (not shown) can supply the same voltage V2 to the respective electrodes without a common terminal unit.

That is, the same voltage can be maintained by supplying substantially the same voltage V1 to the first and third electrodes 21 and 23 and substantially the voltage V2, which is different from the voltage supplied to the first and third electrodes 21 and 23, to the second and fourth electrodes 22 and 24.

FIGS. 12A to 12D are cross-sectional views of the size and location of a cathode spot and an anode spot depending upon a time after a discharge has occurred in the PDP according to a fourth embodiment of the present invention.

After a discharge D has occurred in a region where the distance between the first and second electrodes 21 and 22 formed on the front substrate 20 is the smallest (i.e., the center of the discharge cell 18), a voltage supplied to a discharge gap g decreases as ions and electrons are accumulated. Accordingly, a cathode spot and an anode spot move to the region where surface charges do not exist, i.e., the edge region of the discharge cell 18. Since the voltage supplied to the discharge gap g decreases as time goes by, the intensity of the discharge lowers (see FIGS. 12A and 12B).

Figure 13:
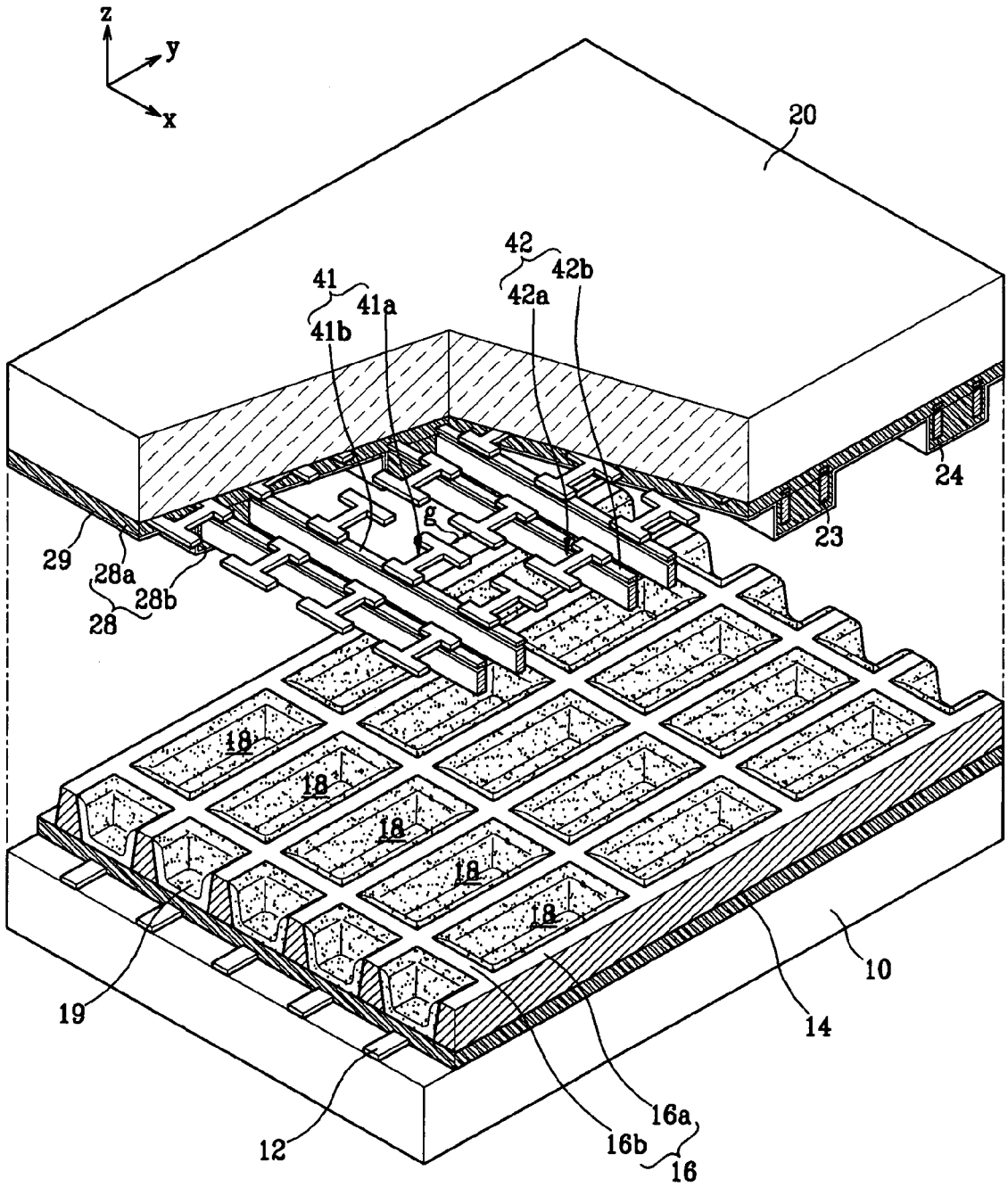
FIG. 13 is an exploded perspective view of a PDP according to a fifth embodiment of the present invention.
Figure 14:
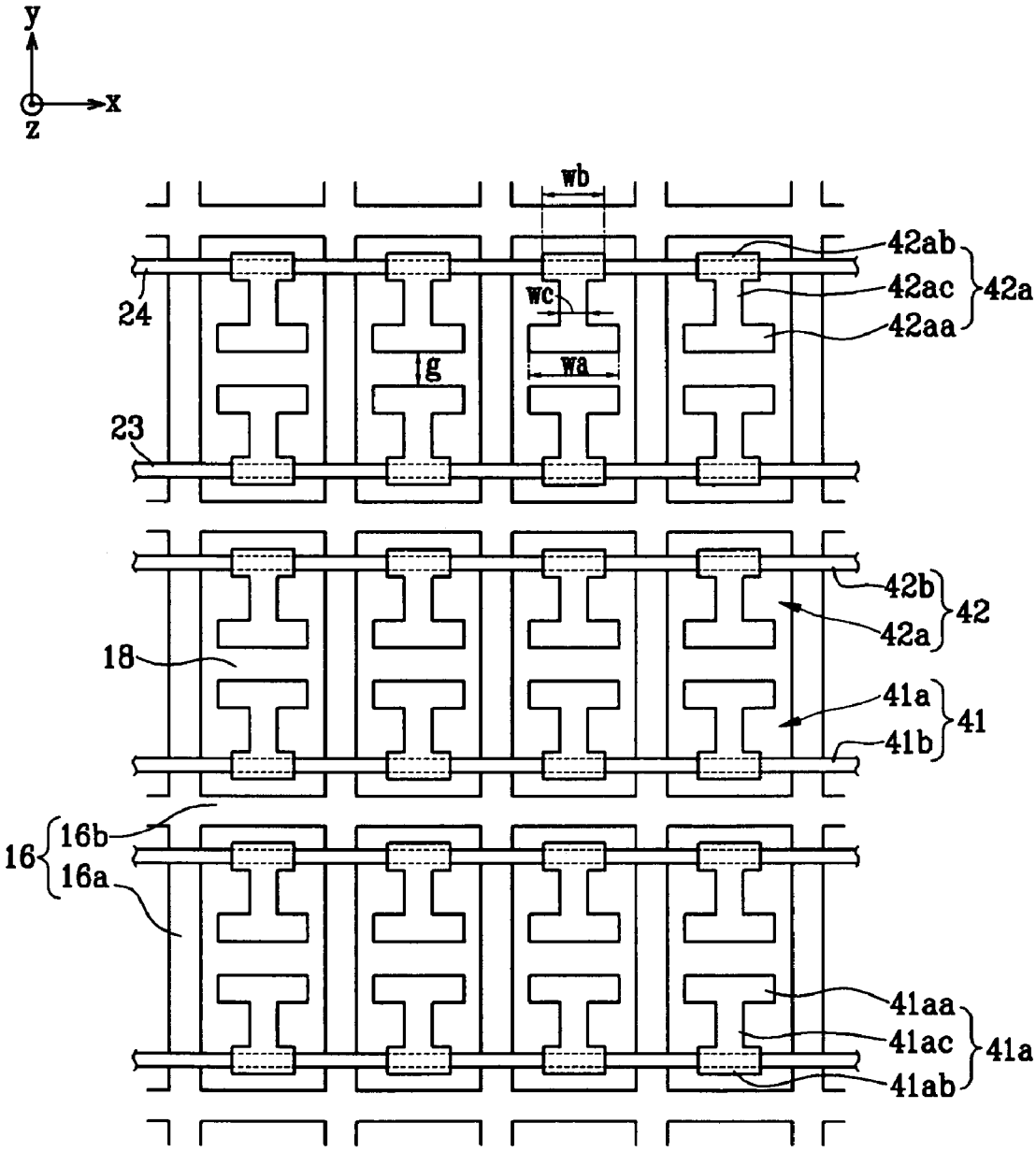
FIG. 14 is a plan view of the structure of electrodes and discharge cells in the PDP according to the fifth embodiment of the present invention.

FIG. 13 is an exploded perspective view of a PDP according to a fifth embodiment of the present invention. FIG. 14 is a plan view of the structure of electrodes and discharge cells in the PDP according to the fifth embodiment of the present invention.

In the present embodiment, a projection electrode 41*a* includes a large-width part 41*aa*, which is disposed at the center of a discharge cell 18 and has a relatively large width (Wa), a small-width part 41*ab*, which is connected to bus electrode 41*b* located at the outer wall of the discharge cell 18 and has a width (Wb) smaller than that of the large-width part 41*aa*, and a connection part 41*ac* that electrically connects the large-width part 41*aa* and the small-width part 41*ab*. Furthermore, a projection electrode 42*a* includes a large-width part 42*aa*, which is disposed at the center of discharge cell 18 and has a relatively large width (Wa), a small-width part 42*ab*, which is connected to a bus electrode 42*b* located at the outer wall of the discharge cell 18 and has a width (Wb) narrower than that of the large-width part 42*aa*, and a connection part 42*ac* that electrically connect the large-width part 42*aa* and the small-width part 42*ab*. The connection parts 41*ac* and 42*ac* have a width (Wc) smaller than the width (Wb) of the small-width parts 42*ab* and 43*ab*.

The large-width parts 41*aa* and 42*aa* are preferably formed to have an area larger than that of the small-width parts 41*ab* and 42*ab* and the connection parts 41*ac* and 42*ac* in order to lower a breakdown voltage between first and second electrodes 41 and 42. The large-width parts 41*aa* and 42*aa* can be formed in a variety of shapes.

Figure 15:
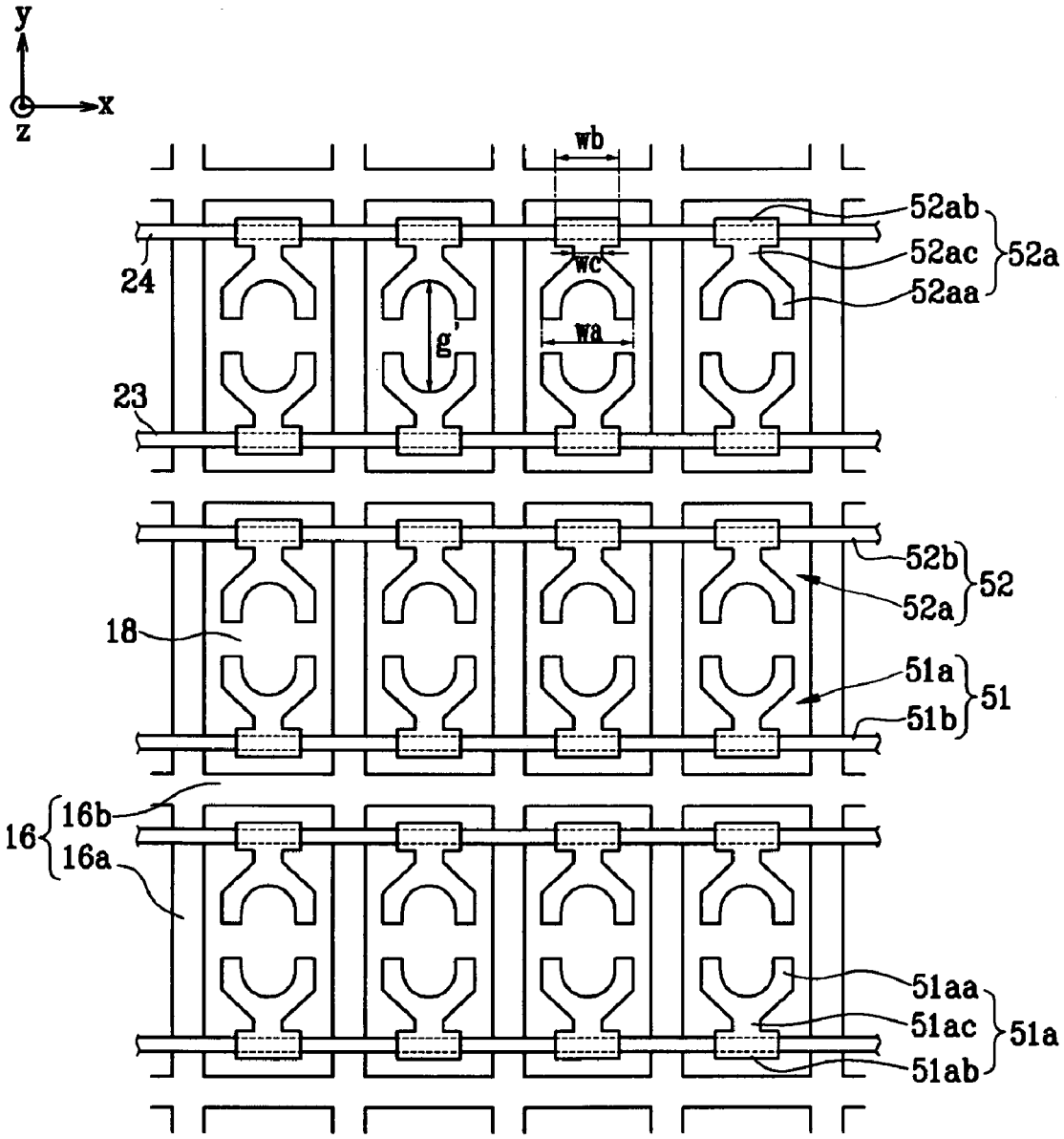
FIG. 15 is a plan view of the structure of electrodes and discharge cells in the PDP according to a sixth embodiment of the present invention.

FIG. 15 is a plan view of the structure of electrodes and discharge cells in the PDP according to a sixth embodiment of the present invention.

The fifth embodiment of FIG. 14 illustrates the large-width parts 41*aa* and 42*aa*, which are formed in a straight line in a direction (the x-axis direction in the drawing) intersecting the address electrodes 12, whereas the sixth embodiment of FIG. 15 illustrates large-width parts 51*aa* and 52*aa*, which extend in the same direction (the Y-axis direction in the drawing) as the direction that the address electrodes 12 extend. The large-width parts 41*aa* and 42*aa* of the fifth embodiment simply form the coplanar discharge structure in the discharge gap g, whereas the large-width parts 51*aa* and 52*aa* of the sixth embodiment form a long gap in which a discharge gap g' is long at the central portion of the discharge cell 18. This can improve the emission efficiency.

Small-width parts 51*ab* and 52*ab* of projection electrodes 51*a* and 52*a* are preferably formed to have a width greater than that of bus electrodes 51*b* and 52*b*. This facilitates the alignment of the projection electrodes 51*a* and 52*a* and the bus electrodes 51*b* and 52*b* when forming the bus electrodes 51*b* and 52*b* on the projection electrodes 51*a* and 52*a*.

Figure 16:
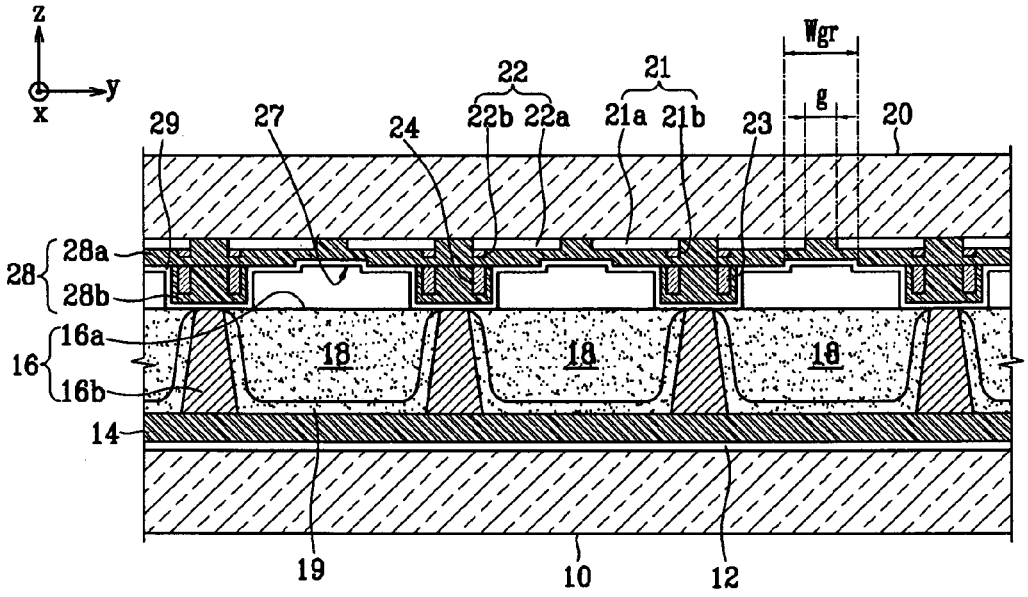
FIG. 16 is a cross-sectional view of a PDP according to a seventh embodiment of the present invention.

FIG. 16 is a cross-sectional view of a PDP according to a seventh embodiment of the present invention.

Referring to FIG. 16, in the present embodiment, grooves 27 are formed in portions corresponding to the centers of discharge cells 18 in a first dielectric layer 28*a*. The grooves 27 are formed to have a predetermined depth and extend along a direction (the x-axis direction in the drawing) intersecting the address electrodes 12. That is, the surface of the first dielectric layer 28*a*, which is close to the edges of the discharge cell 18, projects more than the surface of the first dielectric layer 28*a* at the center of the discharge cell 18. A width (Wgr) of the groove 27, which is measured in a direction parallel to the address electrode 12 (the y-axis direction in the drawing), is greater than a discharge gap g that is formed by first and second electrodes 21 and 22.

The first dielectric layer 28*a* can be formed by etching the first dielectric layer 28*a* corresponding to the center of the discharge cell 18 by means of an etching or sandblasting method.

By forming the groove 27 in the first dielectric layer 28*a*, a thin dielectric layer is formed in the groove 27 region, and a thick dielectric layer is formed in the circumference of the groove 27 region. In the first dielectric layer 28*a*, the capacitance in the groove 27 region is higher than that in the circumference of the groove 27 region.

An electric field is severely distorted around the place where the thickness of the first dielectric layer 28*a* varies due to a difference in the capacitance. That is, a gap voltage supplied to the groove 27 region having a high capacitance is higher than that supplied to the circumference of the groove 27 region. A relatively strong discharge can be obtained in a region in which a discharge path is relatively long (around the place where the thickness of the dielectric layer varies) due to a spatial difference in the gap voltage. It can therefore improve the emission efficiency.

Figure 17:
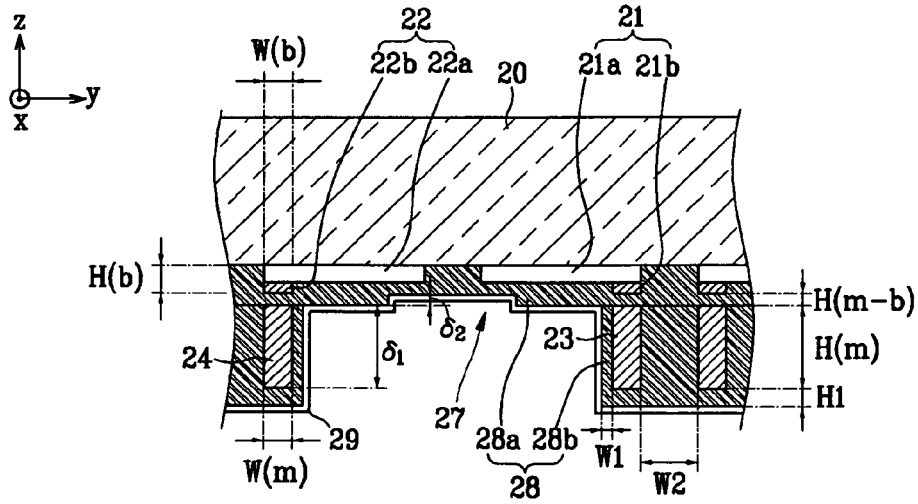
FIG. 17 is a detailed cross-sectional view of the structure of a front plate of the PDP according to the seventh embodiment of the present invention.

FIG. 17 is a detailed cross-sectional view of the structure of the front plate of the PDP according to a seventh embodiment of the present invention.

As described above, since a groove 27 is formed in a first dielectric layer 28*a*, the condition of d2>0 is satisfied, where d2 indicates the depth, which is measured from the surface corresponding to the edge of the discharge cell 18 of the first dielectric layer 28*a* toward the front substrate 20.

Figure 18:
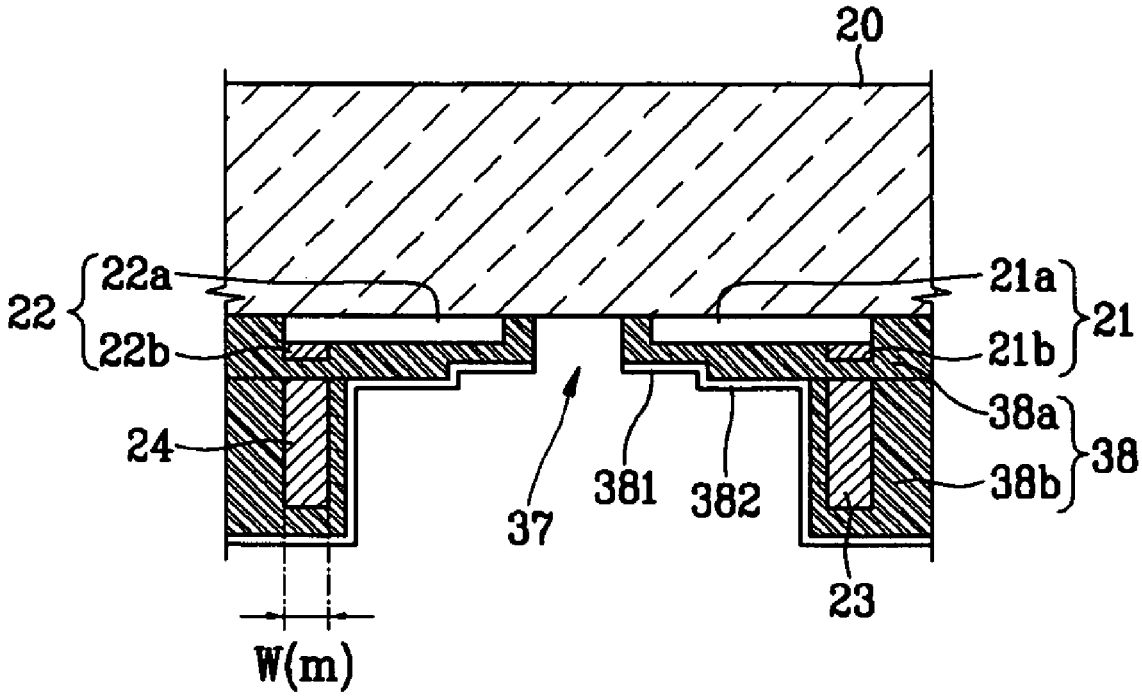
FIG. 18 is a cross-sectional view of the structure of a front plate of a modification of the PDP according to the seventh embodiment of the present invention.

FIG. 18 is a cross-sectional view of the structure of the front plate of a modification of the PDP according to the seventh embodiment of the present invention.

In accordance with the present modification, in a front substrate 20, a first dielectric layer 38*a* is formed to cover first and second electrodes 21 and 22, and a second dielectric layer 38*b* is formed to surround third and fourth electrodes 23 and 24. A groove 37 is formed in the first dielectric layer 38*a*. The groove 37 has the depth so as to expose the surface of the front substrate 20.

Furthermore, the first dielectric layer 38*a* includes a first plane 381 that is formed adjacent to the groove 37 along the groove 37, and a second plane 382, which is formed adjacent to the first plane 381 and is projected toward the rear substrate 10 more than the first plane 381.

A thin dielectric layer is formed in the first plane 381 around the groove 37, and a thick dielectric layer is formed in the second plane 382. The first dielectric layer 28*a* has the capacitance, which is higher in the first plane 381 than in the second plane 382.

An electric field is severely distorted around the place where the thickness of the first dielectric layer 28*a* varies due to a difference in the capacitance. That is, a gap voltage supplied to the first plane 381 having a high capacitance is higher than that supplied to the second plane 382. A relatively strong discharge can be thus obtained in a region where a discharge path is relatively long (around the place where the thickness of the dielectric layer varies) due to a spatial difference in the gap voltage. The emission efficiency can be improved accordingly.

Figure 19:
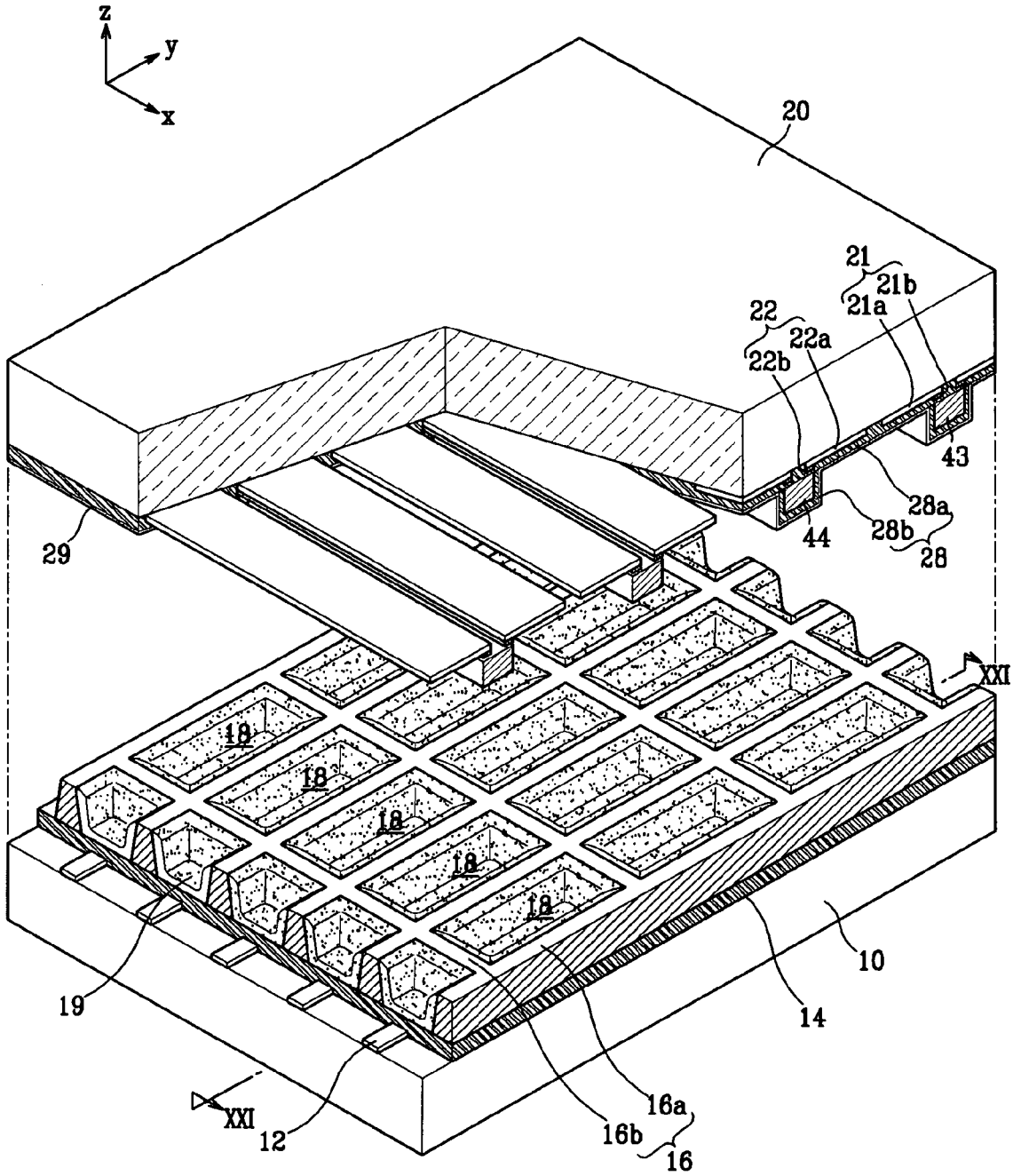
FIG. 19 is an exploded perspective view of a PDP according to an eighth embodiment of the present invention.
Figure 20:
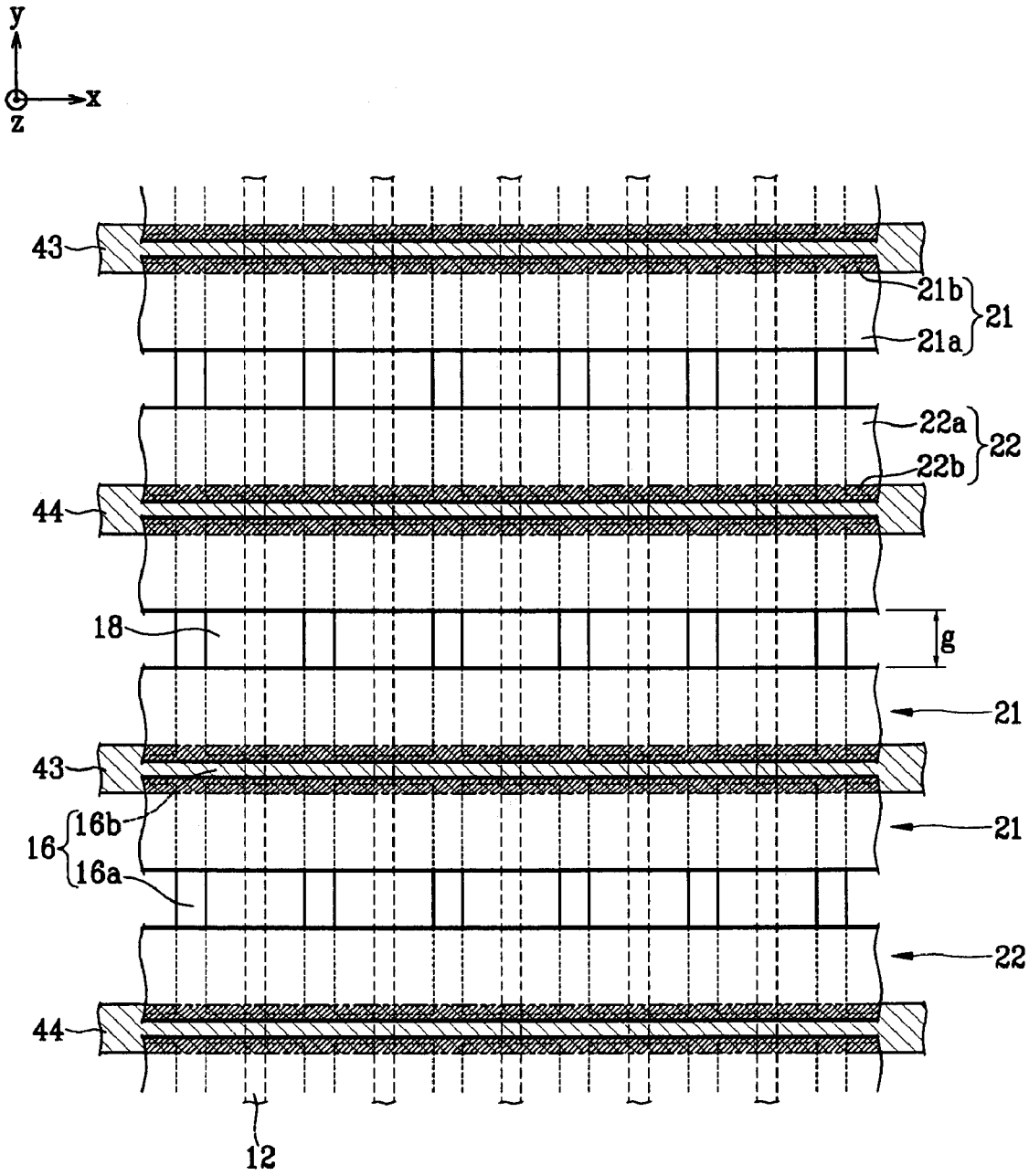
FIG. 20 is a plan view of the structure of electrodes and discharge cells in the PDP according to the eighth embodiment of the present invention.

FIG. 19 is an exploded perspective view of a PDP according to an eighth embodiment of the present invention. FIG. 20 is a plan view of the structure of electrodes and discharge cells in the PDP according to an eighth embodiment of the present invention.

In the present embodiment, first and second electrodes 21 and 22 are alternately disposed in adjacent discharge cells 18 in a direction parallel to address electrodes 12. Specifically, the first electrode 21 of one of the discharge cells 18 is disposed adjacent to a first electrode 21 of another discharge cell 18, and the second electrode 22 is disposed adjacent to a second electrode 22 of another discharge cell 18. Accordingly, the first and second electrodes 21 and 22 have an arrangement of . . . -1-2-2-1-1- . . . , wherein '1' indicates the first electrode, '2' indicates the second electrode.

Figure 21:
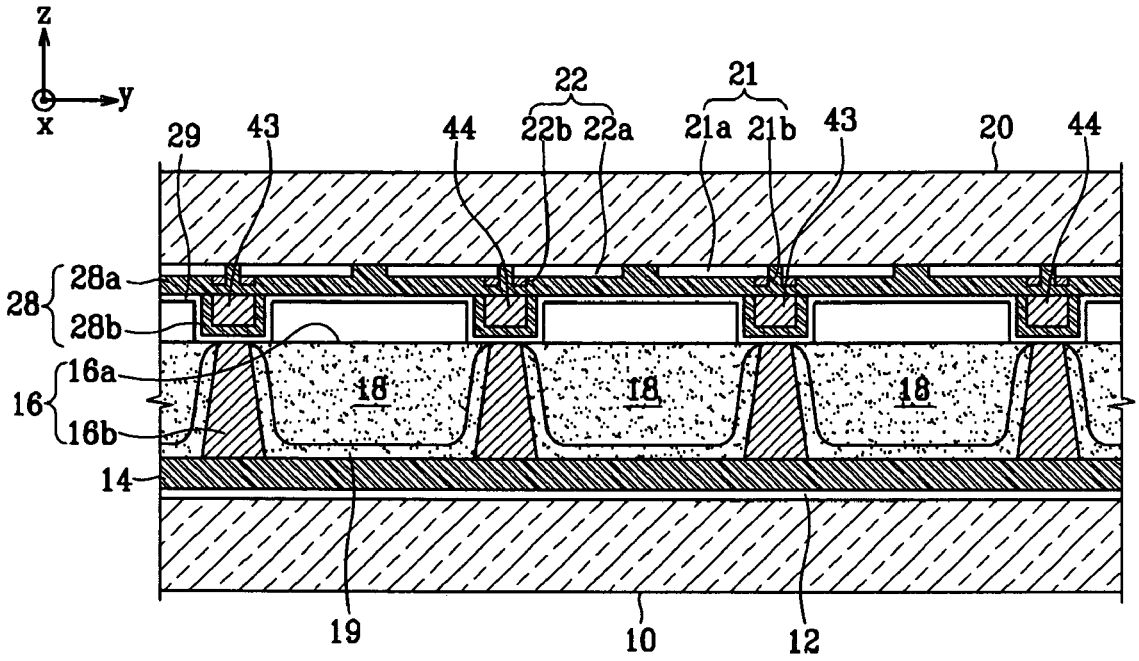
FIG. 21 is a cross-sectional view of the PDP taken along the line XXI-XXI in FIG. 19.

FIG. 21 is a cross-sectional view of the PDP taken along the line XXI-XXI in FIG. 19.

Referring to FIG. 21, in the present embodiment, third and fourth electrodes 43 and 44 are formed on a front substrate 20 so as to be separated from first and second electrodes 21 and 22. The third and fourth electrodes 43 and 44 are disposed in a direction parallel to address electrodes 12, respectively, so that they are shared by a pair of adjacent discharge cells 18. Specifically, the third electrodes 43 or the fourth electrodes 44 are formed along second barrier rib members 16*b* located over the second barrier rib members 16*b*. One electrode is disposed between adjacent discharge cells 18, and is involved in a discharge of the discharge cells 18 on both side thereof. The third and fourth electrodes 43 and 44 formed thus have an arrangement of . . . -3-4-3-4- . . . along a direction parallel to the address electrodes 12, wherein '3' indicates the third electrode, and '4' indicates the fourth electrode.

In the present embodiment, the first electrodes 21 are disposed to correspond to the third electrodes 43. The second electrodes 22 are disposed to correspond to the fourth electrodes 44. The third and fourth electrodes 43 and 44 extend in a direction intersecting the address electrodes 12.

Figure 22:
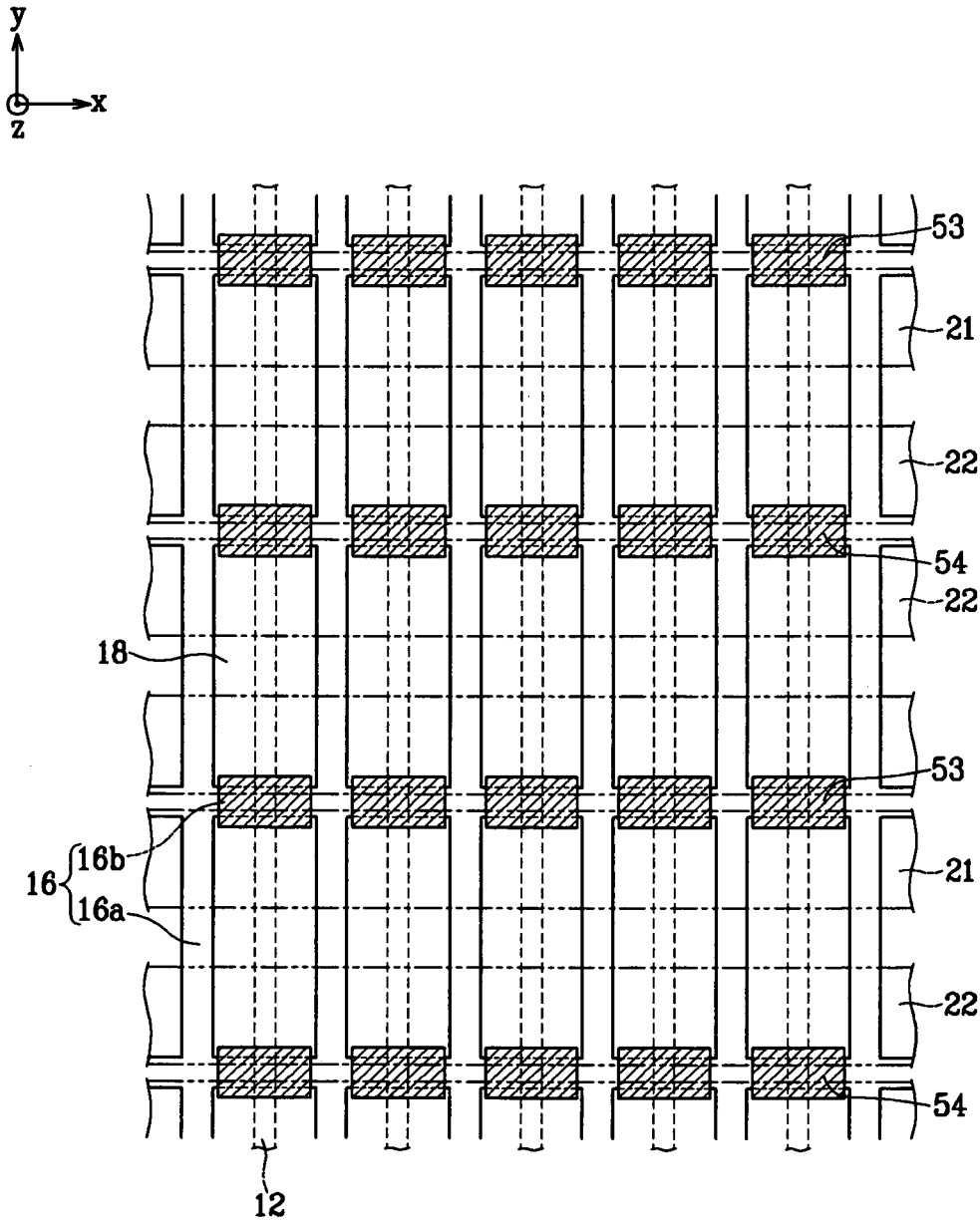
FIG. 22 is a plan view of the structure of electrodes and discharge cells of a PDP according to a ninth embodiment of the present invention.

FIG. 22 is a plan view of the structure of electrodes and discharge cells of a PDP according to a ninth embodiment of the present invention.

In the same manner as in the eighth embodiment, the PDP according to the present embodiment includes third and fourth electrodes 53 and 54, which are formed on a front substrate so as to be separated from first and second electrodes 21 and 22. The third and fourth electrodes 53 and 54 are separated from the first and second electrodes 21 and 22, and are projected toward a rear substrate in a direction away from the front substrate. The third and fourth electrodes 53 and 54 are disposed opposite to each other with a space therebetween. The space can induce an opposite discharge between the third and fourth electrodes 53 and 54 disposed opposite to each other. The third and fourth electrodes 53 and 54 are preferably made of a metal.

Referring to FIG. 22, the PDP according to the present embodiment includes the third and fourth electrodes 53 and 54, which are disposed parallel to each other in a direction in which a plurality of unit electrodes, which are separated from each other, cross the address electrodes 12. A signal voltage for driving the PDP is supplied through the first and second electrodes 21 and 22, and the third and fourth electrodes 53 and 54 become floating electrodes. Furthermore, in the same manner as in the eighth embodiment, a potential difference is generated between the third and fourth electrodes 53 and 54 and the first and second electrodes 21 and 22 due to the capacitive coupling. The first and second electrodes 21 and 22 of the present embodiment can also include bus electrodes and expansion electrodes. However, detailed drawings of the bus electrodes and the expansion electrodes have been omitted for simplicity.

Although the foregoing description is with reference to exemplary embodiments, it can be understood that changes and modifications of the present invention can be made by one of ordinary skill in the art without departing from the spirit and scope of the present invention as defined by the appended claims.

As described above, according to a PDP in accordance with the present invention, the structure of electrodes that are involved in a discharge within discharge cells has a coplanar discharge structure at the center of the discharge cells, and an opposite discharge structure in the edges of the discharge cell. Thus, a discharge, which begins from electrodes at the center of the discharge cell, can be easily transferred to electrodes at the edges of the discharge cells. Therefore, there is an advantage in that a discharge is maintained for a long time around the edges of discharge cells, which is a region having a long discharge path with good emission efficiency.

Furthermore, a dielectric layer formed to surround electrodes constituting an opposite discharge structure forms a dielectric material block between adjacent discharge cells. This can prevent ions and electrons from moving among adjacent discharge cells, and can thus significantly reduce the generation of crosstalk. Accordingly, an erroneous discharge between on and off cells can be reduced.

Furthermore, a dielectric layer that surrounds electrodes constituting an opposite discharge structure is formed of an opaque dielectric material. Therefore, there is an effect in that the bright and dark contrast of a PDP can be improved.

Moreover, a groove is formed in a dielectric layer corresponding to the center of a discharge cell. A gap voltage supplied to a groove region having high capacitance becomes higher than that supplied in the circumference of the groove region. A relatively strong discharge can be obtained in a region where a discharge path is relatively long (around a place where a thickness of a dielectric layer varies) due to an electric field that is distorted by a spatial difference of the gap voltage. Accordingly, the emission efficiency can be improved.

What is claimed is:

1. A Plasma Display Panel (PDP), comprising:

first and second substrates arranged opposite to each other;

address electrodes arranged parallel to each other on the first substrate;

barrier ribs arranged in a space between the first and second substrates to divide a plurality of discharge cells;

phosphor layers respectively arranged within the discharge cells;

first and second electrodes arranged on the second substrate corresponding to the respective discharge cells, the first and second electrodes extending in a direction crossing the address electrodes; and third and fourth electrodes, the third electrode adjacent to and separated from the first electrode and the fourth electrode adjacent to and separated from the second electrode, the third and fourth electrodes projecting toward the first substrate in a direction away from the second substrate, the third and fourth electrodes facing each other with a space therebetween.

2. The PDP of claim 1, wherein the third and fourth electrodes are arranged in layers different from layers in which the first and second electrodes are arranged.

3. The PDP of claim 1, wherein the third and fourth electrodes are separated from each other by the first and second electrodes and a dielectric layer therebetween.

4. The PDP of claim 1, wherein the first and second electrodes are covered with a dielectric layer, and wherein ends of the third and fourth electrodes closer to the first substrate project toward the first substrate more than toward the surface of the dielectric layer in the center of the discharge cell.

5. The PDP of claim 1, wherein the third and fourth electrodes have a thickness in a thickness direction of the panel greater than that of the first and second electrodes.

6. The PDP of claim 1, wherein cross-sections of the third and fourth electrodes, cut in a plane perpendicular to a length direction of the third and fourth electrodes, are longer in a direction perpendicular to the second substrate than in a direction parallel to the second substrate.

7. The PDP of claim 1, wherein the third and fourth electrodes comprise a metal.

8. The PDP of claim 1, further comprising a first dielectric layer arranged to cover the first and second electrodes on the second substrate; wherein the third and fourth electrodes are arranged over the first dielectric layer; and wherein a second dielectric layer is arranged to surround the third and fourth electrodes.

9. The PDP of claim 8, wherein a thickness of the second dielectric layer arranged on a surface in which the third and fourth electrodes face the first substrate is greater than a thickness of the second dielectric layer arranged on a surface in which the third and fourth electrodes are opposite to each other.

10. The PDP of claim 8, wherein the second dielectric layer comprises an opaque dielectric material.

11. The PDP of claim 1, wherein the first and second electrodes are respectively arranged over the discharge cells adjacent to the edges of the discharge cells.

12. The PDP of claim 1, wherein the third and fourth electrodes are respectively arranged over the discharge cells adjacent to the edges of the discharge cells.

13. The PDP of claim 1, wherein each of the first and second electrodes includes bus electrodes respectively corresponding to the discharge cells and extending along a direction intersecting the address electrodes, and expansion electrodes extending from the bus electrodes toward the center of each of the discharge cells.

14. The PDP of claim 13, wherein the third and fourth electrodes are arranged at locations where the third and fourth electrodes overlap the bus electrodes of the first and second electrodes, when seen from the front of the panel.

15. The PDP of claim 13, wherein the width of the bus electrodes of the first and second electrodes is greater than that of the third and fourth electrodes, in a direction parallel to the address electrodes.

16. The PDP of claim 1, wherein the third and fourth electrodes extend in a direction intersecting the address electrodes.

17. The PDP of claim 1, wherein each of the third and fourth electrodes includes a plurality of unit electrodes, the plurality of unit electrodes being separated from each other and arranged parallel to each other in a direction intersecting the address electrodes.

18. The PDP of claim 1, further comprising first and second input terminals respectively connected to the third and first electrodes to receive different respective voltages, and third and fourth input terminals respectively connected to the fourth and second electrodes to receive different respective voltages.

19. The PDP of claim 18, further comprising first and second signal input terminals respectively connected to the first and third electrodes to receive different respective signal voltages.

20. The PDP of claim 18, further comprising first and second signal input terminals respectively connected to the second and fourth electrodes to receive different respective signal voltages.

21. The PDP of claim 18, further comprising a signal input terminal directly electrically connected to the third electrode and electrically connected to the first electrode by a resistor.

22. The PDP of claim 18, further comprising a signal input terminal directly electrically connected to the fourth electrode and electrically connected to the second electrode by a resistor.

23. The PDP of claim 1, further comprising a first input terminal connected to the third and first electrodes to receive the same voltage and a second input terminal connected to the fourth and second electrodes to receive the same voltage.

24. The PDP of claim 23, wherein the terminals of the first and third electrodes are electrically connected together.

25. The PDP of claim 23, wherein the terminals of the second and fourth electrodes are electrically connected together.

26. The PDP of claim 1, wherein each of the first and second electrodes includes bus electrodes that respectively correspond to the discharge cells and extend in a direction intersecting the address electrodes and projection electrodes that project from the bus electrodes toward the center of each of the discharge cells, and wherein the projection electrodes include large-width parts arranged at the centers of the discharge cells, small-width parts arranged to be connected to the bus electrodes and having a width smaller than that of the large-width parts, and connection parts arranged to connect the large-width parts and the small-width parts.

27. The PDP of claim 26, wherein the large-width parts have a width greater than that of the small-width parts, and the small-width parts have a width greater than that of the connection parts.

28. The PDP of claim 26, wherein the large-width parts have an area greater than that of the small-width parts and the connection parts.

29. The PDP of claim 26, wherein the large-width parts are arranged in a straight line along a direction in which the large-width parts cross the address electrodes.

30. The PDP of claim 26, wherein the large-width parts extend in the same direction as that of the address electrodes.

31. The PDP of claim 26, wherein the small-width parts of the projection electrodes have a width greater than that of the bus electrodes.

32. The PDP of claim 26, wherein the small-width parts of the projection electrodes have a width greater than that of the third and fourth electrodes.

33. The PDP of claim 1, further comprising a dielectric layer adapted to cover the first and second electrodes, the dielectric layer including a groove corresponding to the central portion of the discharge cell.

34. The PDP of claim 33, wherein a width of the groove in the dielectric layer, measured in a direction parallel to the address electrodes, is greater than a discharge gap between the first and second electrodes.

35. The PDP of claim 33, wherein the groove in the dielectric layer has a depth adapted to expose the surface of the second substrate.

36. The PDP of claim 33, wherein the dielectric layer includes a first plane arranged adjacent to the groove, and a second plane arranged adjacent to the first plane and projecting toward the first substrate more than towards the first plane.

37. The PDP of claim 1, wherein the first and second electrodes are alternately arranged in discharge cells and are adjacent to each other in a direction parallel to the address electrodes, and wherein, in each of the third and fourth electrodes, one electrode is shared by a pair of discharge cells, the third and fourth electrodes being adjacent to each other in a direction parallel to the address electrodes.

38. The PDP of claim 37, wherein the barrier ribs include first barrier rib members extending in a direction parallel to the address electrodes, and second barrier rib members crossing the first barrier rib members and respectively dividing the discharge cells into independent spaces, wherein the third and fourth electrodes are arranged over the second barrier rib members, and wherein a pair of discharge cells, adjacent in a length direction of the address electrodes, share at least one electrode.

39. The PDP of claim 37, wherein the third and fourth electrodes have a plurality of unit electrodes separated from each other and arranged parallel to each other along a direction intersecting the address electrodes.

* * * * *